US009228689B1

(12) United States Patent
Cline et al.

(10) Patent No.: US 9,228,689 B1
(45) Date of Patent: Jan. 5, 2016

(54) SYSTEM AND METHOD FOR IN-PLACE VENT PIPE RESTORATION

(71) Applicants: Roger Cline, Bluemont, VA (US); Mark MacLean-Blevins, Westminster, MD (US)

(72) Inventors: Roger Cline, Bluemont, VA (US); Mark MacLean-Blevins, Westminster, MD (US)

( * ) Notice: Subject to any disclaimer, the term of this patent is extended or adjusted under 35 U.S.C. 154(b) by 0 days.

(21) Appl. No.: 14/540,795

(22) Filed: Nov. 13, 2014

Related U.S. Application Data

(60) Provisional application No. 61/877,705, filed on Sep. 13, 2013.

(51) Int. Cl.

| | |
|---|---|
| ***E04B 1/00*** | (2006.01) |
| ***E04G 21/00*** | (2006.01) |
| ***E04G 23/00*** | (2006.01) |
| ***F16L 55/16*** | (2006.01) |
| ***E04G 23/02*** | (2006.01) |

(52) U.S. Cl.
CPC ..... *F16L 55/1608* (2013.01); *E04G 23/008* (2013.01); *E04G 23/0214* (2013.01); *E04G 23/0281* (2013.01)

(58) Field of Classification Search
CPC ..... F16L 55/1608; E04G 23/008; E04G 23/0214; E04G 23/0281; E04D 13/143; E04D 13/147; E04D 13/1476; E04D 13/1407; E04D 13/1415; E04F 17/04; E04F 17/026; E04F 17/02; F24F 7/02; F23J 13/04; H05B 3/58; E03F 5/08; B29C 66/5221
See application file for complete search history.

(56) References Cited

U.S. PATENT DOCUMENTS

| | | | | | |
|---|---|---|---|---|---|
| 89,403 | A | * | 4/1869 | Hall | 126/314 |
| 1,349,894 | A | * | 8/1920 | Lord | 285/43 |
| 1,352,248 | A | * | 9/1920 | Coar | 285/4 |
| 1,923,220 | A | | 8/1933 | Lightbown | |
| 3,797,181 | A | | 3/1974 | Nievelt | |
| 3,992,045 | A | * | 11/1976 | Whittell, Jr. | B01D 63/065 210/497.2 |
| 4,115,961 | A | | 9/1978 | Bishop | |
| 4,372,585 | A | | 2/1983 | Evora | |
| 4,581,863 | A | * | 4/1986 | Thaler | 52/126.2 |
| 5,245,804 | A | | 9/1993 | Schiedegger et al. | |
| 5,778,611 | A | * | 7/1998 | Michel | 52/198 |
| 6,076,862 | A | * | 6/2000 | Barth et al. | 285/123.1 |
| 6,244,006 | B1 | | 6/2001 | Shue et al. | |
| D486,891 | S | | 2/2004 | Cronce, Jr. | |
| D550,346 | S | | 9/2007 | Ness | |
| D554,749 | S | | 11/2007 | Ness | |
| D662,230 | S | | 6/2012 | Cline | |
| 8,272,186 | B2 | | 9/2012 | Manning | |
| 8,413,687 | B1 | | 4/2013 | Woodring | |
| 8,484,914 | B2 | | 7/2013 | Cline | |
| 8,490,351 | B1 | * | 7/2013 | Scott | 52/219 |
| 2008/0098673 | A1 | * | 5/2008 | Johnston et al. | 52/198 |
| 2011/0000154 | A1 | * | 1/2011 | Cline | 52/219 |
| 2011/0005156 | A1 | | 1/2011 | Laufer | |

* cited by examiner

*Primary Examiner* — Brian Mattei
(74) *Attorney, Agent, or Firm* — Rosenberg, Klein & Lee

(57) ABSTRACT

A system and method are provided for simple yet reliable replacement and sealing of existing vent pipe penetrations through an external surface of a structure such as a building's roof. The system and method replace a portion of an existing vent pipe with a sealed replacement pipe extension. The replacement pipe extension and remaining portion of the existing vent pipe are preferably combined with a pipe flashing structure to provide a sealed replacement pipe solution capable of withstanding torsional and side loads encountered in rooftop applications. The system and method enable replacement and sealing tasks quickly and at low cost.

20 Claims, 29 Drawing Sheets

SYSTEM AND METHOD FOR IN-PLACE VENT PIPE RESTORATION

RELATED APPLICATION DATA

This Application is based on Provisional Patent Application No. 61/877,705 filed 13 Sep. 2013.

BACKGROUND OF THE INVENTION

Various structures are provided with pipe systems, such as vent pipe systems, which lead from inside the structure to terminate at point outside an external surface of the structure for venting purposes. For example, every home with indoor plumbing has a vent component that allows atmospheric air to enter the plumbing drain system. Today, this vent is most commonly made of standard Schedule 40 DWV PVC pipe and is established in a vertical manner penetrating through the roof of the home. However, historically the vent pipe was formed by a mixture of differing pipe materials, some were of cast iron, some were of iron pipe material and some were of copper pipe material. Hence, a given home built within the last twenty years or so will most likely have a schedule 40 PVC vent pipe, although copper may have been used on some architecturally specified higher-end homes; while homes older than this may have a vent pipe of cast iron, iron, or copper. In addition, the number and size(s) of the vent pipe(s) is/are typically determined during construction by the plumber or other professional in accordance with applicable national, state, and local regulatory requirements like building/plumbing codes. These vent pipes may typically be as small as 1¼" pipe or as large as 4" pipe depending on the particular plumbing system within the home. Common vent pipe sizes for example include 1¼", 1½", 2", 3" and 4" Schedule 40 PVC DWV.

Since this vent pipe component penetrates the roof structure and the water shedding covering (such as roof shingles), a flashing seal must be used to insure the water-tight integrity of the roof system. Roof covering installers are typically tasked with the installation of these flashing seal components during the installation of the roof covering materials. Since the vent pipe element may be made from one of several materials and may be one of several sizes for any particular home, a roof contractor will need to be ready to address the flashing seal to any one of these vent pipe situations (for example, 4 materials and 5 potential pipe sizes=20 different combinations that may be present on any given roof system).

Roof penetrations are sealed with flashings to prevent the ingress of moisture into the attic spaces of a residence or commercial building. Often, these penetrations are provided to accommodate pipes for venting plumbing systems within the building or structure. These pipes are vertically oriented and are often of standard Schedule 40 PVC DWV pipe material which is commonly a white color. As noted, prior to the use of PVC for plumbing pipe applications, other materials were used to manufacture the pipe. Cast iron and copper were the two main materials used for vent pipe manufacture prior to the introduction of PVC; as such there remains a multitude of buildings with existing plumbing infrastructure of cast iron and copper. The cast iron pipes will most often have a surface which is pitted and rough; and, many times, previous flashing seals were applied with various caulks, mastics, or tar; which leaves remnant material that becomes hardened to the exterior of the pipe. A copper pipe tends to oxidize and thin-out due to acid rain and other long-term weathering effects. A copper pipe will also be found with remnants of mastic, caulk and sealants hardened to the exterior.

Since these cast iron and copper vent pipes have been in-use for many years, they may have seen several roof covering replacement events. With each roof covering replacement the vent pipe is once again sealed in an effort to prevent moisture intrusion. In most instances of these older vent pipe installations the flashing seal has been covered with roof cement, sealant of one form or another or just plain tar; leaving the exterior surfaces covered with an array of old hardened adhesives as well as years of accumulated debris. These old crusty coated surfaces are difficult to work with and cause much frustration when trying to clean so as to provide an adequate sealing surface for a new flashing.

Attaining a water-tight seal to the oxidized, rough, pitted, and irregular surface of an existing pipe, other than PVC is difficult at best and sometimes practically impossible. Current remedies for this situation include accessing the pipe within the attic space under the roof and splicing a new piece of pipe into the existing system. This operation is expensive, time consuming and often extremely difficult, as the vent pipes are located in an inaccessible portion of the attic space.

Hence, there exists a need to assist the contractor with a means to repair the old crusty vent pipe penetrations and allow a flashing to be installed to provide adequate sealing for protection against the intrusion of moisture into the building or residence.

SUMMARY OF THE INVENTION

It is an object of the present invention to provide a system and method for in-place pipe restoration.

It is a further object of the present invention to provide a system and method for in-place pipe restoration wherein partial replacement of an in-place pipe may be reliably accomplished without the need to access an internal area of a structure.

It is another object of the present invention to provide a system and method for in-place pipe restoration that provides for adaptive coupling of a replacement pipe section different in diametric size from an existing pipe section.

These and other objects are accomplished in a system formed in accordance with certain embodiments of the present invention for reliable partial replacement of an existing pipe traversing an external surface of a structure. The system includes a replacement pipe section and a coupler unit detachably extending from the replacement pipe section for installation on an existing pipe section. The coupler unit defines an inner passage for communication between the replacement and existing pipe sections therethrough. The coupler unit includes a first section for coaxially engaging the existing pipe section. The first section includes a trunk portion and an adaptive engagement portion which extends radially therefrom. The coupler unit also includes a second section joined to the first section by an intermediate section. The second section coaxially engages the replacement pipe section. The intermediate section includes a shoulder portion which extends radially beyond at least one of the first and second sections.

In certain embodiments a system for reliable partial replacement of a vent pipe traversing an external surface of a structure is provided. The system includes a replacement pipe section and a coupler unit detachably coupled to the replacement pipe section for installation on an existing vent pipe section. The coupler unit defines an inner passage for communication between the replacement and existing vent pipe sections therethrough. The coupler unit includes a first section for coaxially engaging the existing vent pipe section. The first section includes a trunk portion and an adaptive engagement portion extending radially outward therefrom. The adaptive engagement portion includes a plurality of deflectable radial fins axially spaced one from the other. Each radial fin extends annularly about the trunk portion. A second section is coaxially joined to the first section by an intermediate section. The second section coaxially engages the replacement pipe section. The intermediate section includes a shoulder portion which extends radially beyond the second section and each of the radial fins. The radial fins deflectably engage an inner surface of the existing vent pipe section upon engagement of the coupler unit therewith.

In certain other embodiments, a method is provided for reliable partial replacement of a vent pipe traversing an external surface of a structure. The method includes: cutting away a terminal section of the vent pipe extending from the structure beyond the external surface to leave an existing vent pipe section. The method further includes establishing a replacement pipe section. Additionally, the method includes configuring a coupler unit to include a first section and a second section. The first section is contoured to coaxially engage the existing vent pipe section. The first section includes a trunk portion and an adaptive engagement portion extending radially outward therefrom. The second section is joined to the first section by an intermediate section. The second section is contoured to coaxially engage the replacement pipe section. The intermediate section includes a shoulder portion extending radially beyond at least one of the first and second sections. The method also includes detachably coupling the coupler unit by the second section thereof to the replacement pipe section. Furthermore, the method includes installing the coupler unit and the replacement pipe section by coaxially inserting the coupler unit first section into the existing vent pipe section. The coupler unit defines an inner passage for communication between the replacement and existing vent pipe sections therethrough. Finally, the method includes coupling a pipe flashing unit in sealed manner to the replacement pipe section above the coupler unit. The pipe flashing unit includes a sealing portion situated to extend about the replacement pipe section for enshrouding the coupler unit and a joint formed thereby with the existing vent pipe section.

DETAILED DESCRIPTION OF THE PREFERRED EMBODIMENTS

Figure 1:
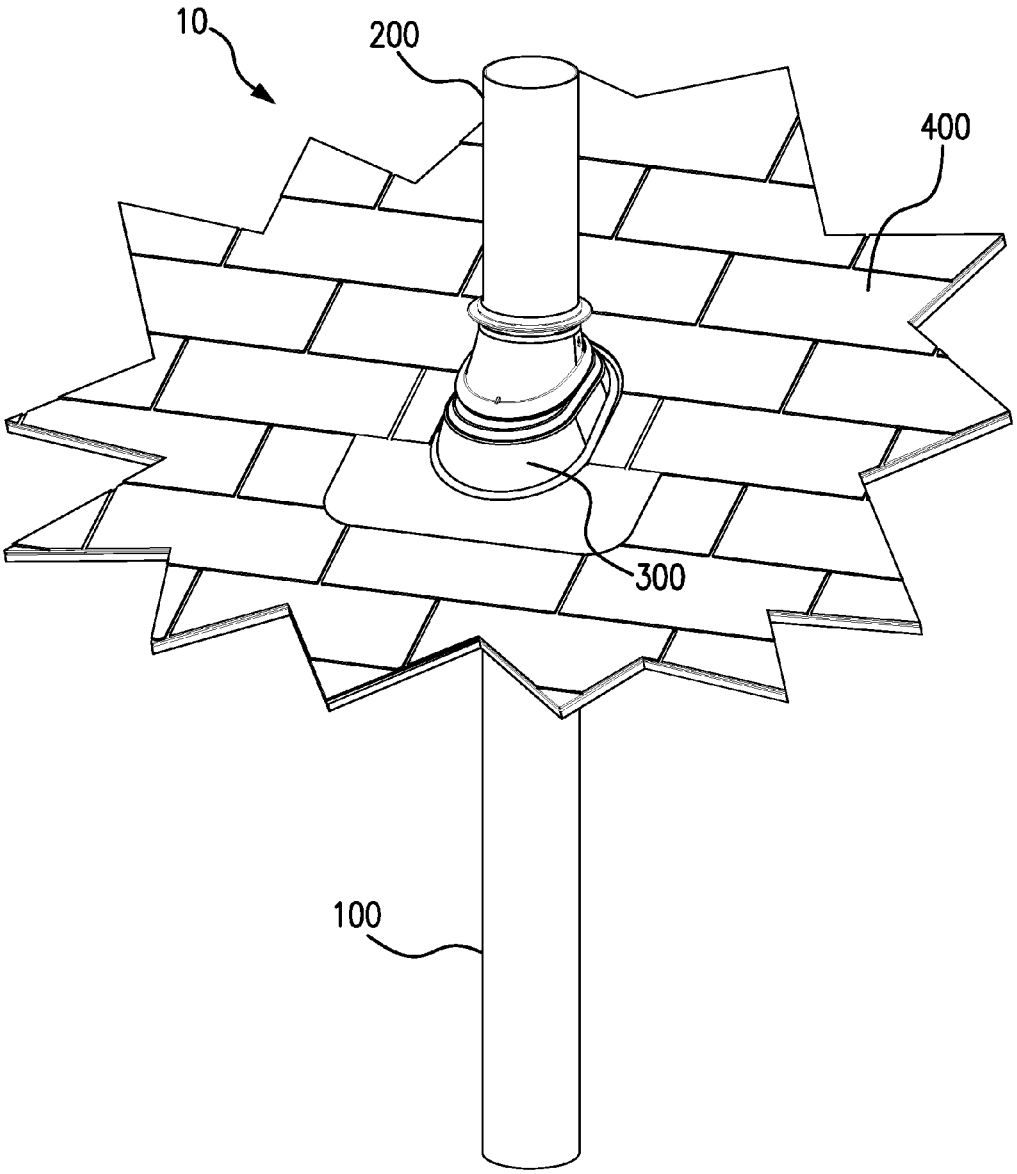
FIG. 1 is a perspective exterior view of a portion of a roof structure shown with a vent pipe penetration utilizing the vent pipe fit system Replacement Pipe Extension formed in accordance with an exemplary embodiment of the present invention, with a pipe flashing in position and layered in with the roof covering shingles.

A pipe fit system formed in accordance with one exemplary embodiment of the present invention provides a simple, easy to use, and inexpensive solution for damaged and/or difficult to seal vent pipe problem for various existing structures. While it finds particularly useful application with vent pipe systems of various structures (buildings, machinery, or the like), the pipe system may be used to partially replace and thereby retrofit various types of non-pressure pipe systems serving different structures.

The system generally includes amongst its features a replacement pipe section, preferably manufactured from solid PVC. However, alternative suitable materials may be used which enable a replacement pipe section to be engineered to precise exterior dimensions to exactly match standard Schedule 40 DWV PVC pipe, so that the standard commonly available resilient or elastomeric vent pipe flashing seals designed for PVC pipe may be used. An adaptive engagement portion in the form of a pliable component with, for example, having one or more radial fin elements allows the "new" replacement pipe section to be press-fit adaptively into the top of the existing pipe, once the damaged portion is cut away and removed. This pliable component may be bonded to the rigid PVC pipe component to be inseparable from the pipe element. Preferably, three depressed ring features are molded into the pliable component to assist with the bonding process. The three radial fin elements are sized to accommodate the internal diameter and tolerance range for the pipes to which it will be affixed; allowing it to be press-fit into the heaviest wall cast iron pipe as well as the thinnest wall copper pipe and still provide sufficient retention force and sealing efficiency. Since the pliable component is preferably manufactured from a resilient material, the three radial fins shown act to seal the internal volume of the vent pipe, prohibiting the gasses within the vent pipe from escaping to the outside the vent pipe atmosphere within the flashing seal (within the building or other structure, under the roof covering) and potentially entering the attic or living spaces of the home. For additional retention to the original pipe, or for maximum sealing efficiency, a caulk or other supplemental sealant material may be applied around the pliable component to reinforce the seal between the pliable element and the internal diameter of the original pipe. A replacement pipe section formed in accordance with an embodiment of the vent pipe fit system may be manufactured as needed to suit, for example, each PVC pipe size currently used—size specific for direct replacement.

The finished system, including the "new" (replacement) pipe and an Ultimate Pipe Flashing unit (such as illustrated in certain FIGS.) combine to provide a replacement solution capable of enduring the life of the roof covering materials. The heavy wall cross-section of the pliable component used in accordance with an exemplary embodiment of the vent pipe fit system along with the Compression Ring support of the Ultimate Pipe Flashing provide superior resistance to ice and snow loads that may be encountered by vent pipe installations. The solid rigid PVC material used for the exterior portion of a coupler unit formed in accordance with an exemplary embodiment of the vent pipe fit system ensures resistance to UV and other weather related degradation.

The method of installation of the vent pipe fit system formed in accordance with certain embodiments of the subject invention generally includes, first, prior to installing new roof covering materials the existing original (damaged or impossible to seal) cutting the existing vent pipe approximately at the roof line—preferably, this cut is substantially perpendicular to the axis of the pipe. The joint where the replacement pipe and the original pipe meet (the cut surface) is preferably disposed within the underside (dry side) of the flashing seal component; this becomes an issue at steeper roof slopes since the available room under the flashing seal get diminished as the roof gets steeper. Second, the inside surfaces of the (now cut) original pipe is wiped as clean as possible, then a coupler unit is pressed into the pipe until it is properly seated. When a preliminary portion of the roof covering materials are laid in position and ready, the flashing seal is installed over the "new" pipe component and seated onto the roof covering material, in a manner suitable for the given flashing seal unit.

Once the flashing seal is seated, the roof covering materials may continue to be applied until the flashing device is fully integrated into the roof covering system. The entire installation typically takes just minutes and is completed entirely from the exterior of the roof in a simple, quick, and effective manner. In certain roof applications of the subject system and method, the vent pipe is preferably to be a dark color and, in most cases, it gets painted a black color. Hence, the component parts of the vent pipe fit system are manufactured in a black color from the factory, thereby relieving the roof contractor from the need to apply paint. A white (or any other color) version may be manufactured as well dependent upon the particular requirements and/or preferences in the intended application. In addition, a copper or other such fascia sleeve may be provided over the visible pipe component to accommodate an architectural specification of an exterior copper vent pipe, while maintaining the cost efficiency and ease of installation of a PVC vent pipe system within the home.

Given the old crusty adhesive covered pipe extension penetrating a roof surface to be recovered with new roofing materials, or, perhaps given an old pipe penetration which is leaking and just needs to be resealed; the roofing repair professional or contractor must properly prepare the pipe for installation of a new flashing seal component. In accordance with certain aspects of the present invention, assist is provided to a roofing professional in that regard via the system and a method herein.

The method formed in accordance with certain exemplary embodiments of the present invention (as illustrated in FIGS. 18A-18H) generally includes removing an existing crusty and/or damaged pipe section (existing pipe section) extending through the roof penetration and replacing it with a replacement pipe section. The entire operation of implementing the method of the present invention occurs preferably from outside an exterior surface of the roof or other structure where vent pipe replacement is desired. Access to the underside of the roof is not required to implement this method. The existing pipe portion extending through a building's roof penetration, for example, is cut off, approximately perpendicular to the axis of the pipe preferably at the lowest point possible at the roof line. The cut edges are quickly de-burred or otherwise smoothed with a file or sandpaper, removing sharp burrs or fragments. Then the pipe extension device (also referred to herein as the coupler unit) formed in accordance with certain embodiments of the present invention is simply pressed into position onto the existing pipe until a portion of it is seated fully in the pipe. Once installed a roof professional may install the new roof flashing component and roof covering materials to complete the restoration process.

The pipe extension device generally comprises two main elements which are preferably inseparably bonded to one another and formed to provide sufficient dimensional precision to adapt to the pipe flashing component at one portion and a range of (within a suitable dimensional tolerance for the intended application) various diameters of existing pipe at another portion. The enables a given size pipe extension device to fit to several different cast iron pipe classifications (such as soil pipe, heavy cast iron, extra heavy cast iron, hubless cast iron, to name a few), each of which may have a slightly different wall thickness and internal diameter.

The method and device of the present invention combine to effect quick and easy removal of an old and troublesome portion of an existing vent pipe portion and quick and easy replacement thereof with a new, clean, and precise replacement pipe section to allow excellent sealing with a new pipe flashing component.

Referring now to FIGS. 1-18H, there is shown a vent pipe system formed in accordance with an exemplary embodiment of the present invention as applied to a building structure's roof system.

Turning to FIG. 1, shown therein is an illustrative perspective exterior view of a portion of a roof system 10 with an existing vent pipe 100 retrofitted with a pipe extension device 200, about which a pipe flashing unit 300 is installed and roof covering materials (such as roofing shingles) 400 fully installed or re-installed thereafter to yield a completely restored weather tight roof vent pipe system.

Figure 2:
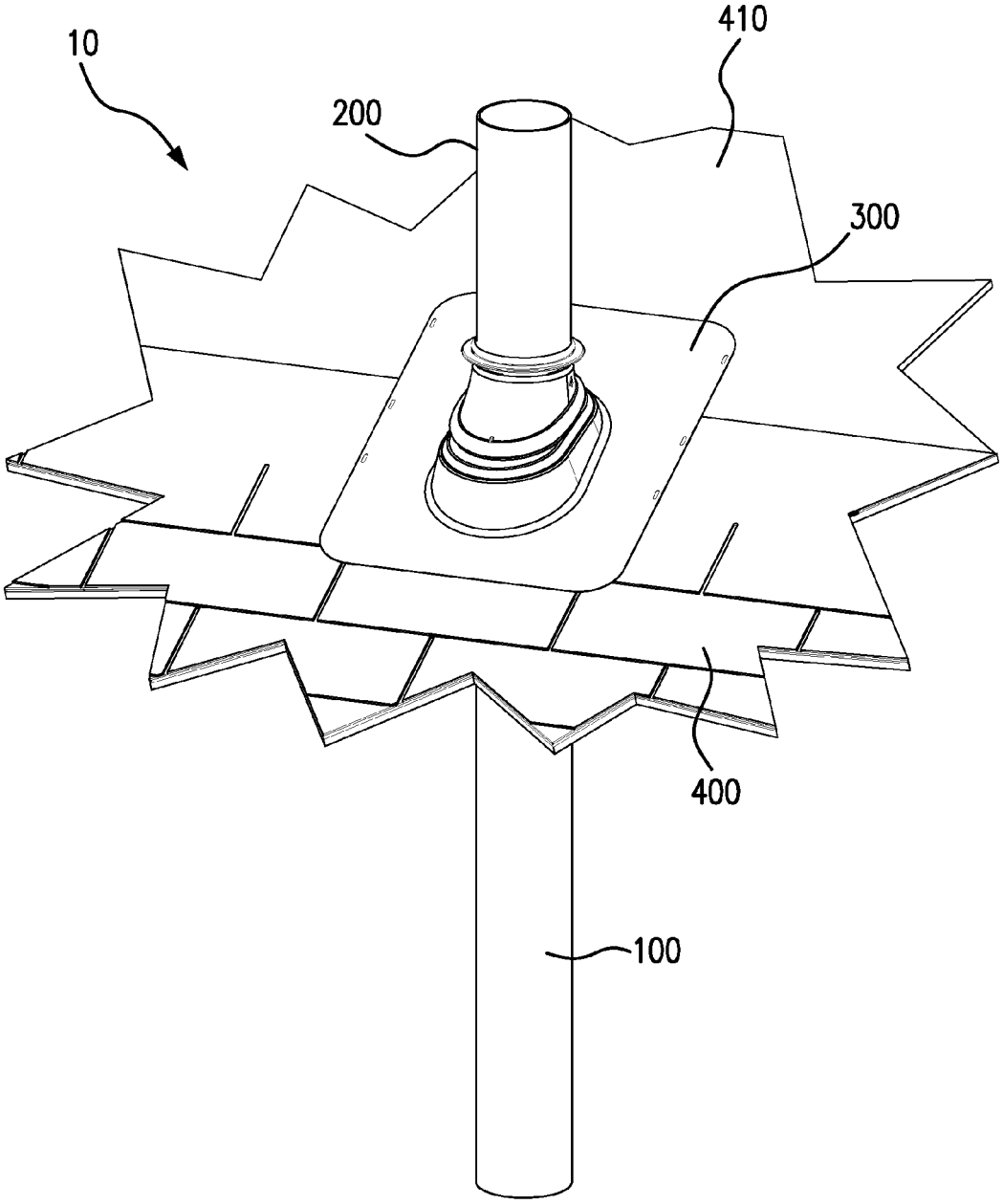
FIG. 2 is a perspective exterior view of a portion of a roof structure, as shown in FIG. 1 shown just after installation of the pipe flashing and before installation of the roof covering shingles above the penetration flashing.

Turning to FIG. 2, shown therein is an illustrative perspective exterior view of a portion of a roof system 10 with a portion of the roof covering materials 400 partially installed onto the roof substrate 410 up to the pipe penetration elevation. The pipe extension device 200 is installed onto the existing pipe 100, with the pipe flashing 300 installed over the pipe extension device 200 and onto the roof covering materials 400 and roof substrate 410.

Figure 3:
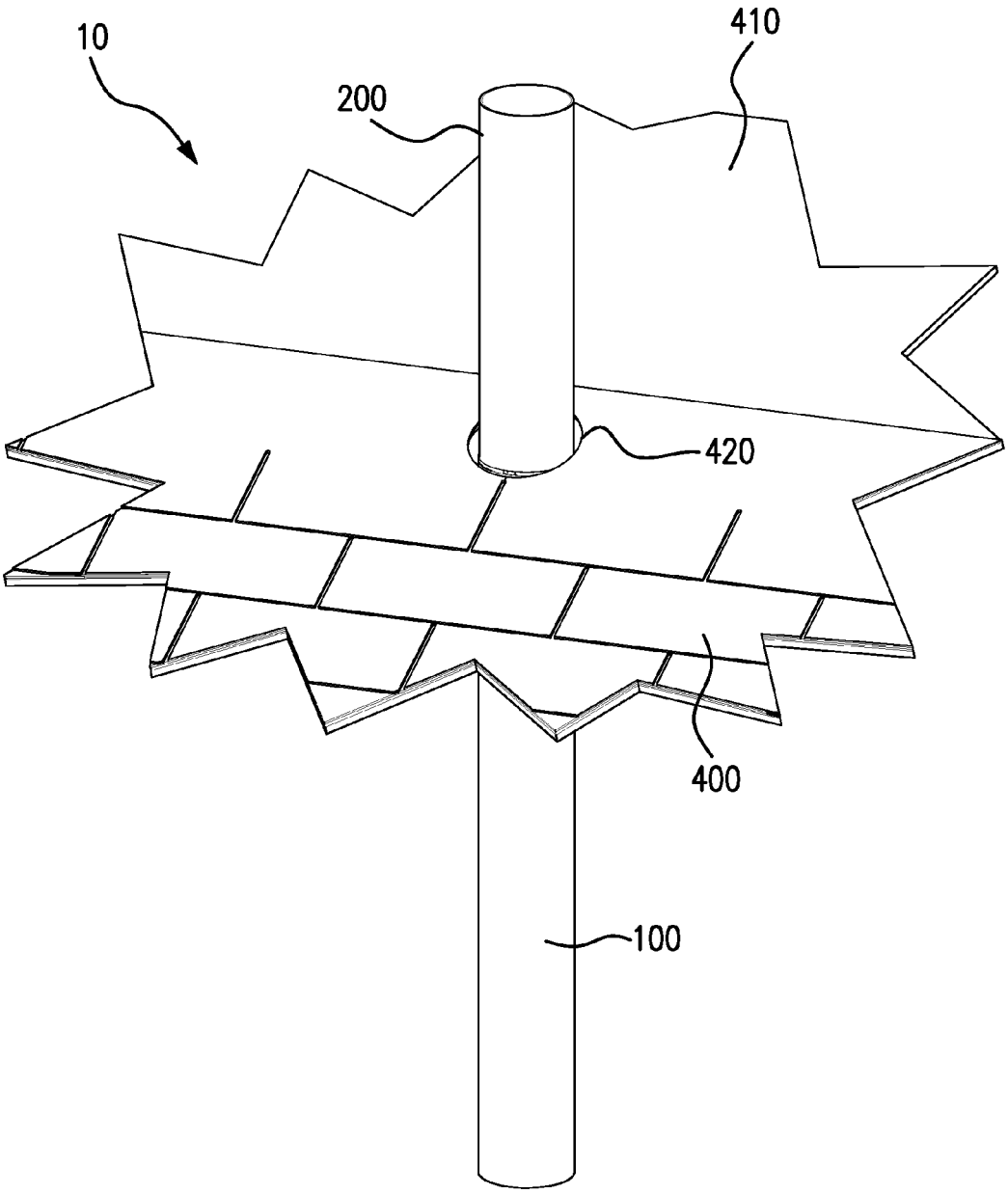
FIG. 3 is a perspective exterior view of a portion of a roof structure, as shown in FIG. 1 shown just before the installation of the pipe flashing with the vent pipe fit system Replacement Pipe Extension shown installed in the existing vent pipe and penetrating the roof.

Turning to FIG. 3, shown therein is an illustrative perspective exterior view of a portion of a roof system 10 with a portion of the roof covering materials 400 partially installed onto the roof substrate 410 up to the pipe roof penetration 420 elevation, and with the pipe extension device 200 installed into the existing pipe 100.

Figure 4:
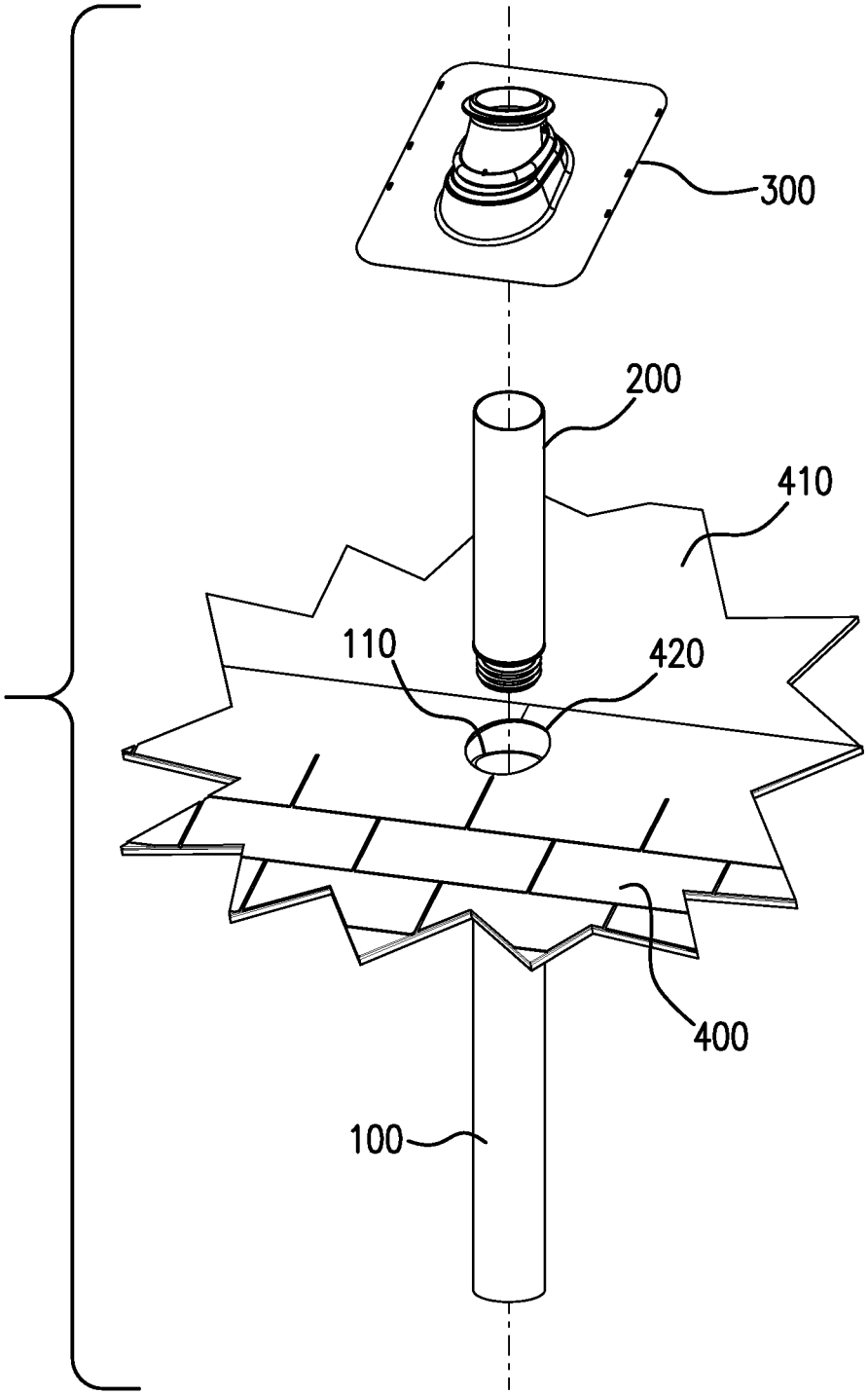
FIG. 4 is an exploded perspective view showing the existing vent pipe as cut and prepared to accept the Replacement Pipe Extension in the embodiment of FIG. 1, with the pipe flashing ready to be installed.

Turning now to FIG. 4, shown therein is an exploded view of a portion of the roof system 10 as illustrated in FIG. 2; comprising the roof substrate 410, the roof covering materials 400, the existing pipe 100, with cut surface 110, shown after removal of a pipe portion extending beyond the roof penetration 420. Also shown are the pipe extension device 200 and the pipe flashing 300.

Figure 5:
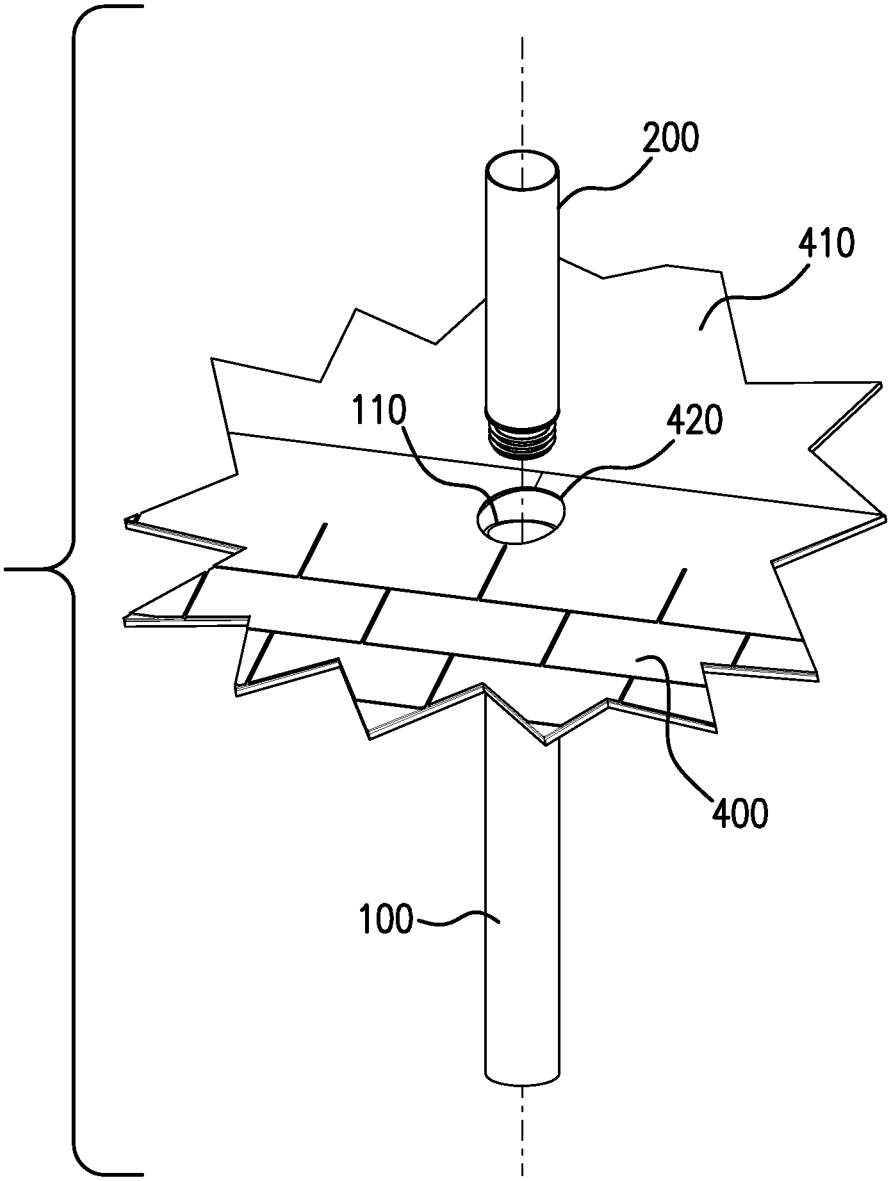
FIG. 5 is an exploded perspective view showing the existing vent pipe as cut and prepared to accept a Replacement Pipe section, and showing the vent pipe fit system ready to be installed.

Turning to FIG. 5, shown therein is an exploded view of a portion of the roof system 10 as illustrated in FIG. 3; comprising the roof substrate 410, the roof covering materials 400, the existing pipe 100 with cut surface 110, shown after removal of the pipe portion extending beyond the roof penetration 420, and the pipe extension device 200.

Figure 6:
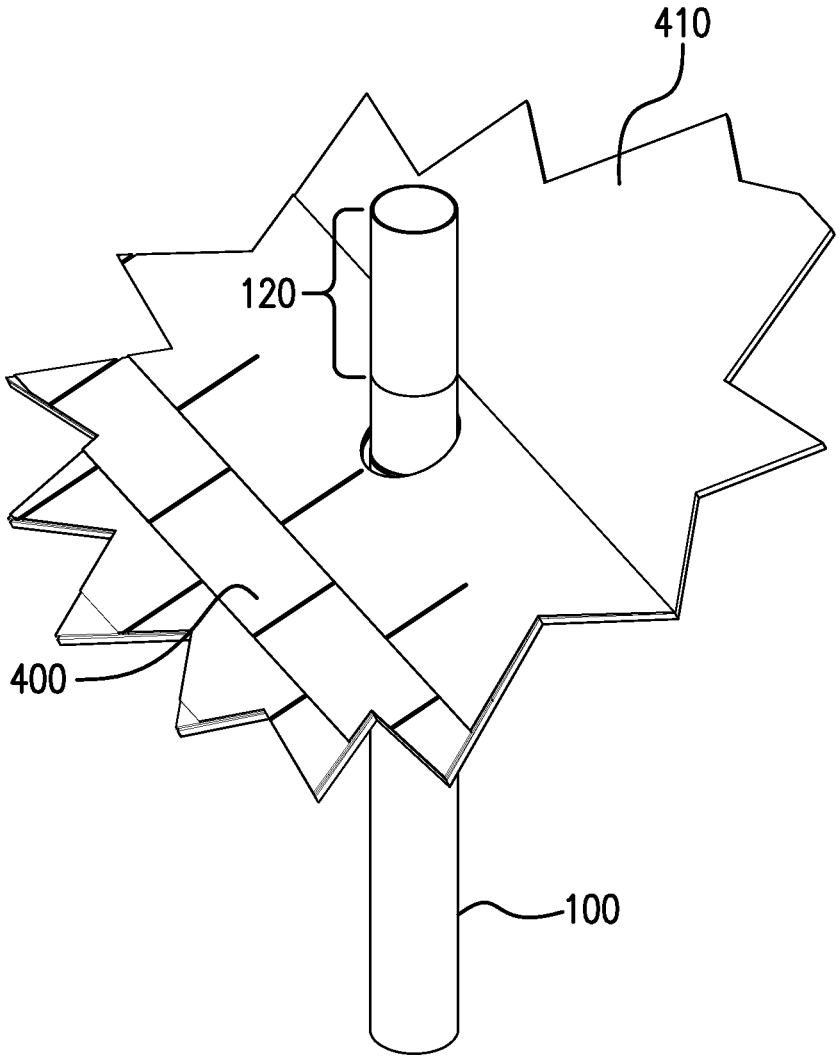
FIG. 6 is an perspective view of a portion of a roof structure as shown in FIG. 3 shown with the existing pipe extending through the roof opening prior to being cut and removed for installation of the vent pipe fit system Replacement Pipe Extension.

Turning now to FIG. 6, shown therein is an illustrated perspective view of a portion of the roof system 10, with the existing pipe 100 extending through roof penetration 420. The previously exposed and sealed surface area 120 is shown ready to be cut at the roof line and removed.

Turing to FIGS. 1-6, when reviewed in a reverse numerical order, there are shown the processes carried out to implement in one exemplary embodiment a method of replacing the existing (and practically impossible to seal) portion 120 of the existing pipe 100. Briefly, this is carried out by cutting at the penetration 420, leaving cut surface 110 exposed and ready for insertion of the replacement pipe extension device 200 which includes in the embodiments illustrated herein a replacement pipe section equipped with a coupler unit 250. Once the device 200 is fully seated onto the existing pipe section remaining after the cut, the pipe flashing unit 300 may be installed over the replacement pipe extension device 200, seating against the roof structure 410 and extending partially over the preliminarily installed roof covering materials 400. Thereafter, the remainder of the roof covering materials 400 may be applied to complete the installation and complete the in-place roof vent restoration preserving a watertight, weather tight roof system.

Figure 7:
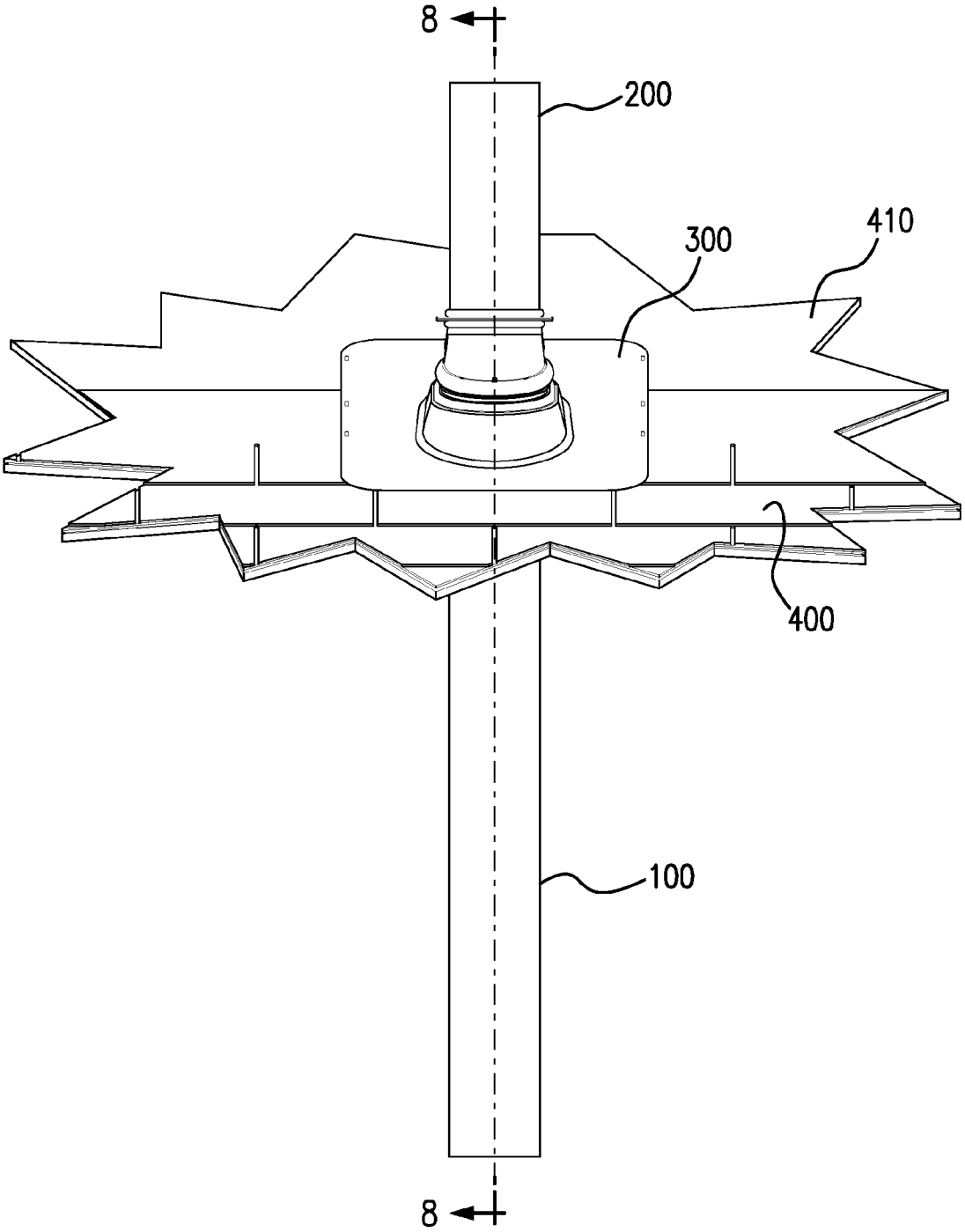
FIG. 7 is a front elevational view of the vent pipe fit system embodiment as illustrated in FIG. 2.

Turning to FIG. 7, shown therein is a front elevational view of a portion of the roof system 10 as illustrated in FIG. 2.

Figure 8:
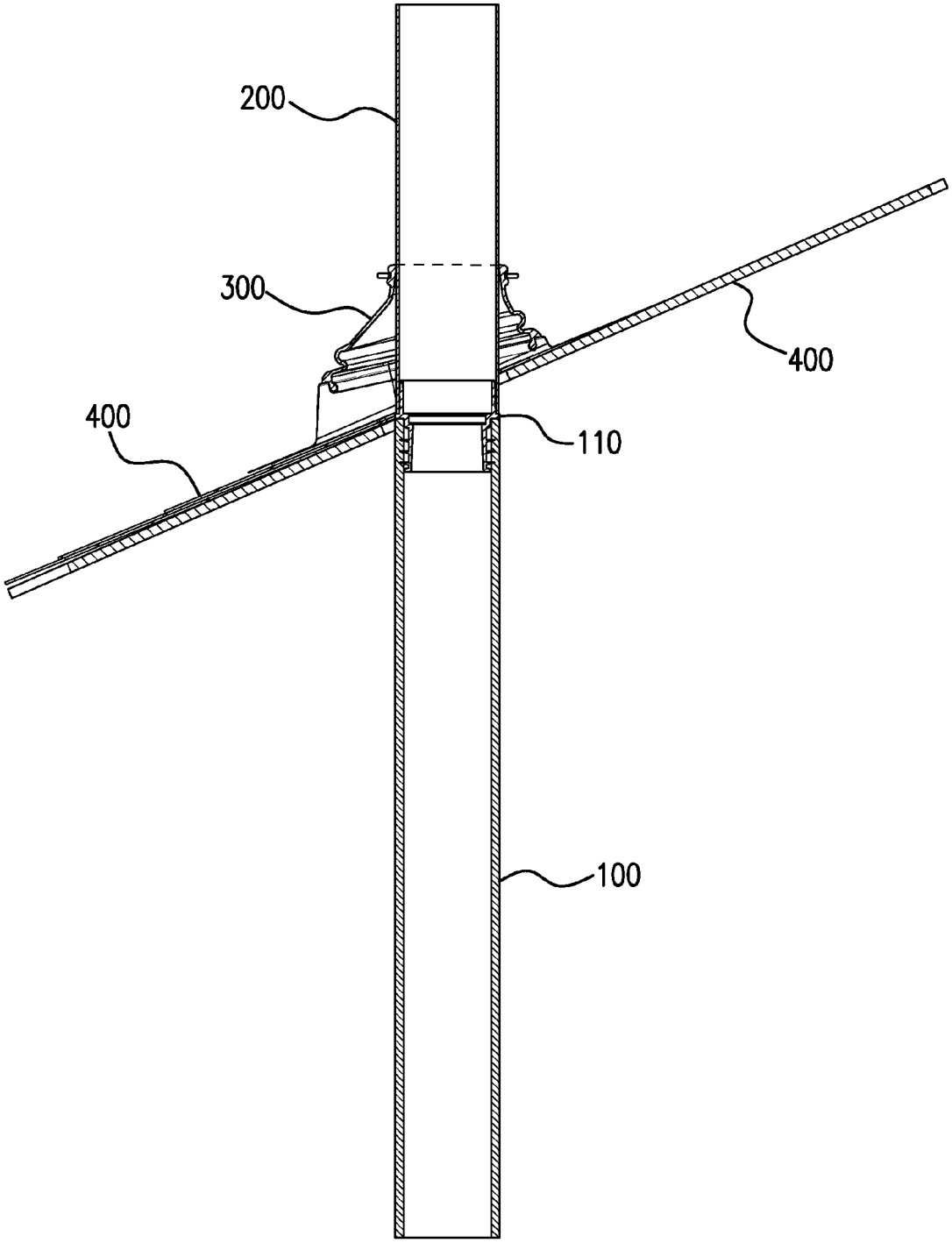
FIG. 8 is a sectional view of the vent pipe fit system from line 8-8 as illustrated in FIG. 7.

Turning to FIG. 8, shown therein is a cross-sectional view taken from line 8-8 of FIG. 7, illustrating certain internal details of the connection between the existing pipe section 100 and the replacement pipe section of the device 200.

Figure 9:
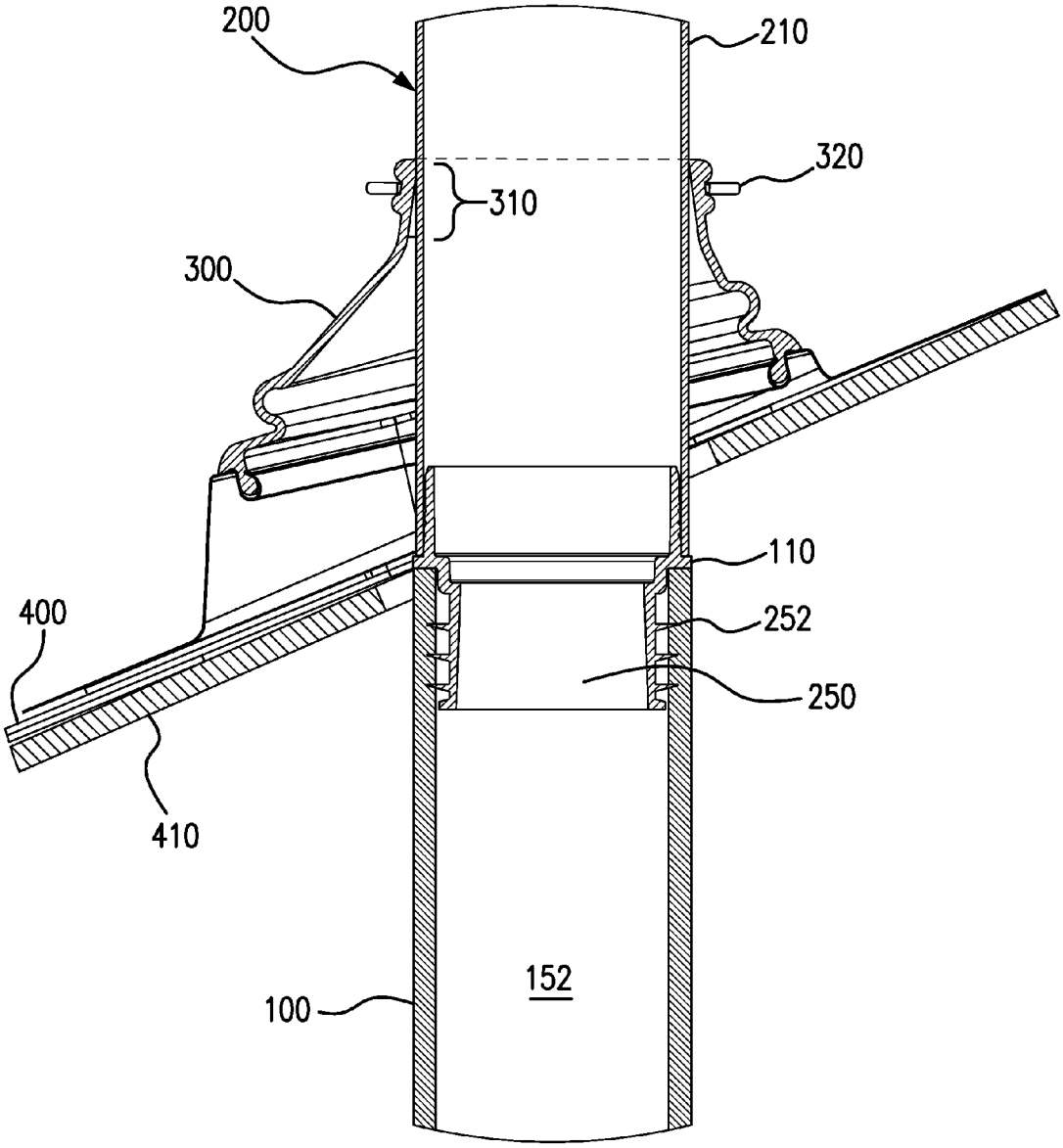
FIG. 9 is an enlarged view, partially cut away, of the vent pipe fit system shown in FIG. 8.

Turning to FIG. 9, shown therein is an enlarged view of the cross sectional view as illustrated in FIG. 8 showing certain internal details of the connection between the existing pipe section 100 and the replacement pipe section of the device 200 as protected by the pipe flashing 300, when installed on roof substrate 410 and covered with roof covering materials 400. The rigid round extended portion 210 of the pipe extension 200 is manufactured from a rigid PVC material with a suitable wall thickness to withstand the pipe flashing seal compressive forces, and is shown extending through a seal zone 310 defined about the replacement pipe section by components of the pipe flashing unit 300. The connection fitting 250 of the pipe extension device 200 is preferably formed of a suitable semi-flexible molded PVC material but may also be formed of more rigid material, though the radial flanges 252 which extend therefrom are of suitable material composition and configuration to remain deflectable for adaptive sealing engagement against the existing pipe section. The connection fitting 250 is shown as installed in position and seated against the cut surface 110 of the existing pipe 100.

Figure 15:
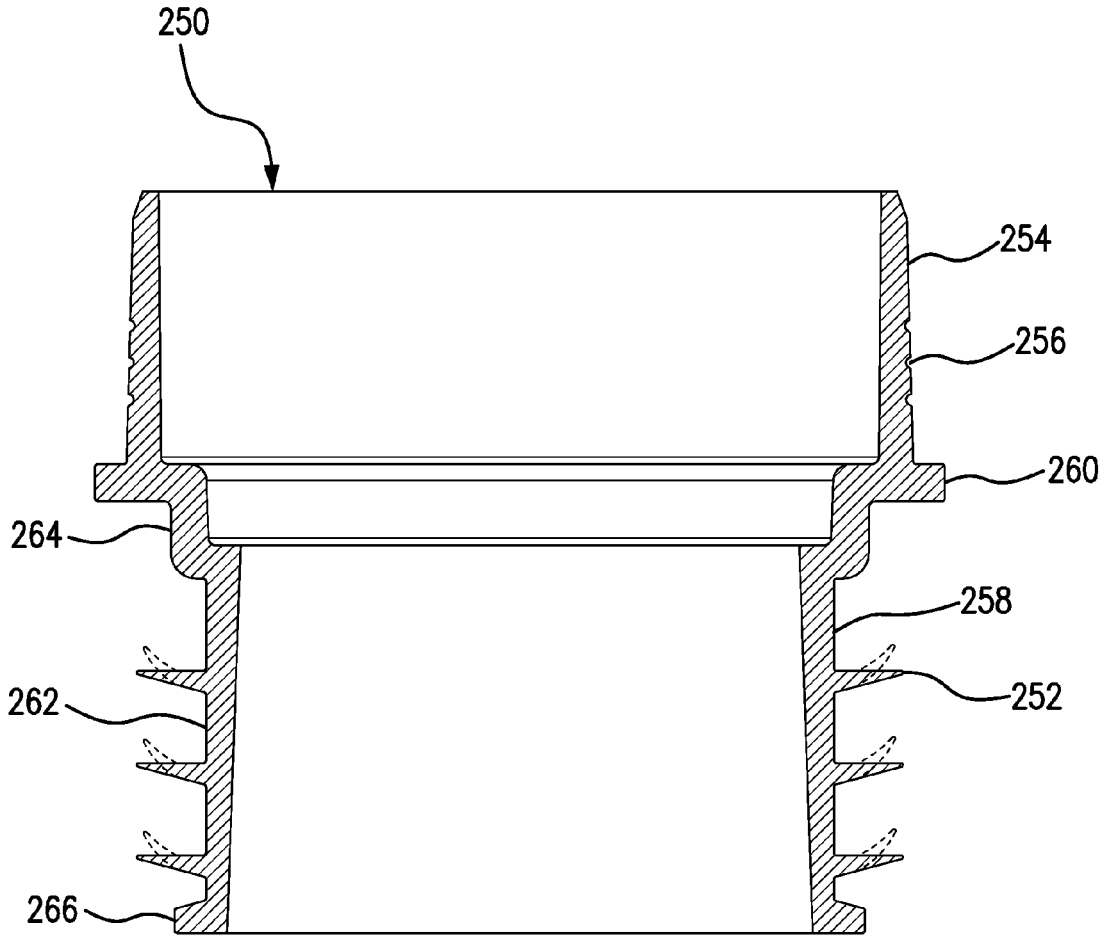
FIG. 15 is a sectional view as taken from line 15-15 in FIG. 14, illustrating the deflection of radial fins.

An adaptive engagement portion having radial extending fins 252 (also referred to herein as "radial flanges") extend radially from a tubular base/trunk portion of the connection fitting 250. In the illustrated embodiment, they extend outwardly from the tubular base portion of connection fitting 250 (also referred to herein as "coupler unit") and bear against the inner wall surface 152 of the existing pipe 100, although in certain alternate embodiments, such as where the connection fitting fits about the existing pipe, they may extend suitably inward to engage an outer wall surface thereof. The thin cross-section of the radial fins 252 in combination with the semi-flexible material properties, allow these radial fins 252 to be flexed to a bent condition during installation into the existing pipe section 100. However, the molded-in residual stresses within the radial fins tend to provide a tight spring-like biasing force on the inside surface 152 of the existing pipe providing holding force and providing an airtight seal to some degree. This holding force provided by the radial fins 252 in interference with the inside surface of the existing pipe 100 is coupled with the compression seal between the pipe flashing 300 and the rigid round extended portion 210 of the replacement pipe section of the pipe extension device 200 create a powerful holding force securing the pipe extension 200 within the existing pipe 100. In FIGS. 8, 9, 9A, and 9B, radial fins 252 are shown without deflection for clarity and simplicity. However, when inserted into the existing pipe section 100, the radial fins 252 will preferably deflect (much in the manner as shown in FIG. 15) against the interior of the existing pipe section 100.

Preferably though not necessarily, the one or more radial fins 252 of the coupler unit are integrally formed as shown with other portions of that coupler unit. For example, each radial fin may be integrally formed with the tubular portion of the coupler unit from which they extend, or separately attached thereto. The radial fins and the other portions of the coupler unit may be formed of any suitably resilient, deflectable material known in the art to provide the adaptive coupling with the replacement and existing vent pipe sections as disclosed herein with sufficient strength and durability to suit the particular requirements of the intended application. Where the radial fins are separately provided, of course, the remaining portions of the coupler unit may be formed of other more rigid materials suitable to the particularly intended application.

The combination of holding points—one at the internal diameter of the existing pipe 100 and one at the seal zone 310 of the pipe flashing unit 300—provides torsional resistance to side loads on the replacement pipe section of the pipe extension device 200 from snow and the like. Molded connection fitting 250 has a cylindrical form with a wall thickness chosen to withstand these torsional loads as applied by snow loads and the like. Those skilled in the art will readily recognize that the shape and dimensional configurations of the connection fitting 250 shown, much like the other parts of the disclosed system, are illustrative. The specific configurations employed will depend on the particular requirements of the intended application. Where, for example, the replacement pipe section is subjected to greater loads, the connection fitting may be formed for instance with a more extended lower section better leveraged coaxial coupling to the existing pipe section.

The embodiment as shown with pipe flashing unit 300 benefits from the extreme sealing capability afforded in the seal zone 310 by the rigid compression ring element 320 such as more fully disclosed in U.S. Pat. No. 8,484,914. If a lesser performing pipe flashing were to be used, then the resistance to torsional loads, as well as the holding force (retaining the replacement pipe section of the pipe extension device 200 in the existing pipe 100) would be less, resulting in potential failure with appreciable snow loads or other side or torsional loads. Hence, from a system perspective the replacement pipe extension device 200 of the present invention is preferably specified for use with the superior sealing and support functionality of the pipe flashing as provided in U.S. Pat. No. 8,484,914 in a roof penetration application.

Figure 9A:
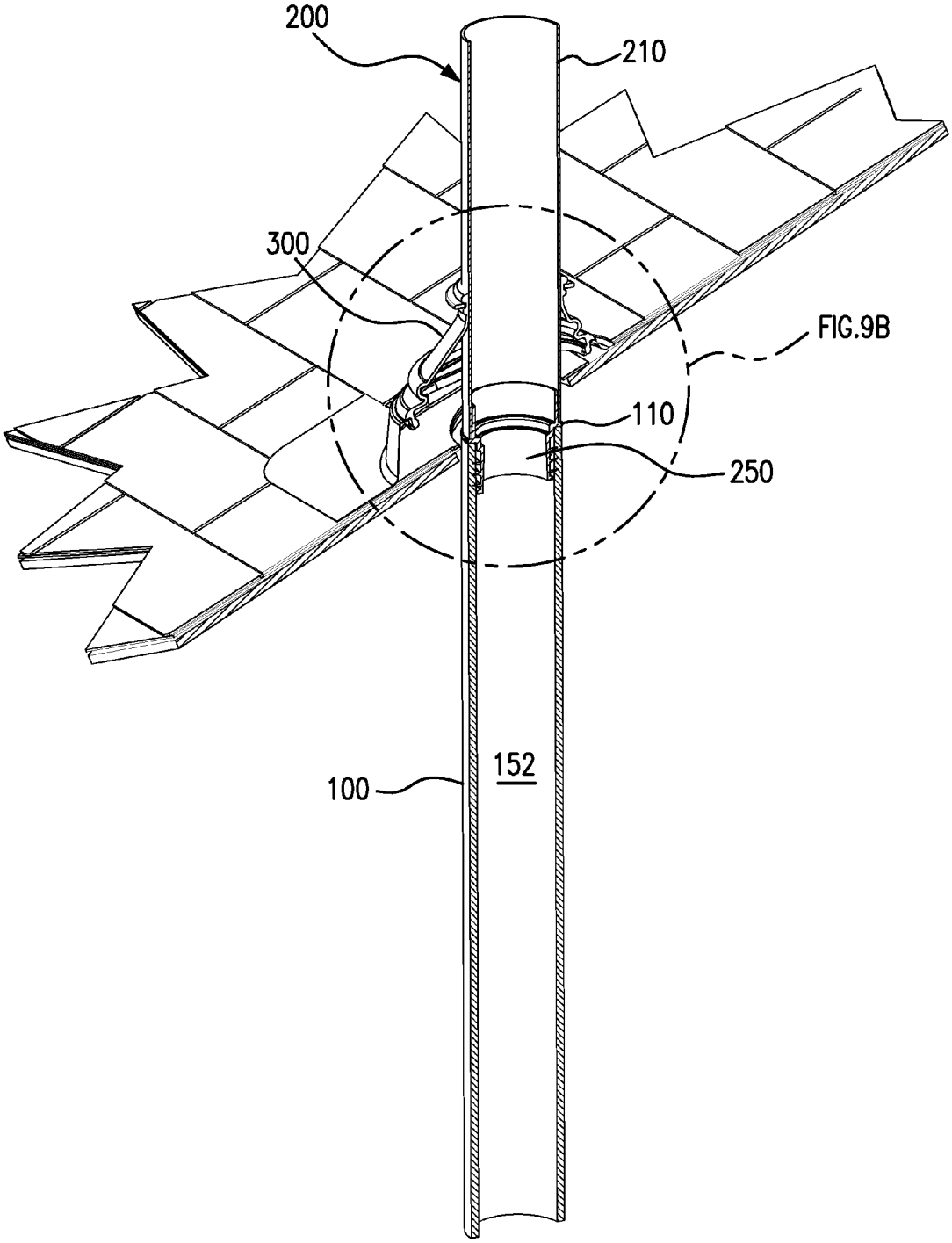
FIG. 9A is a sectional view of the vent pipe fit system embodiment.
Figure 9B:
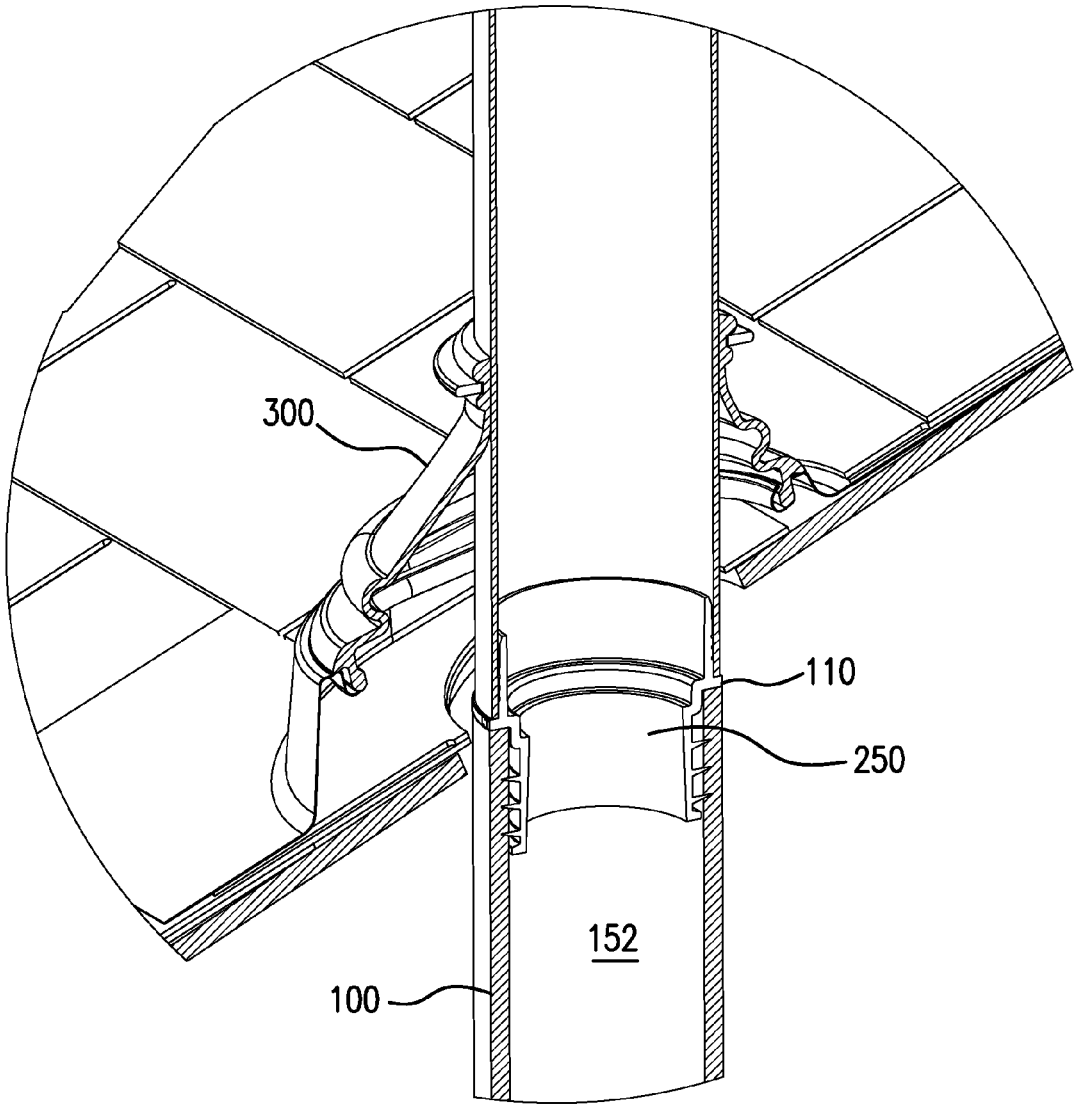
FIG. 9B is an enlarged sectional view of the vent pipe fit system embodiment shown in FIG. 9A.

Turning now to FIG. 9A, there is shown a cross-sectional view of a fully-assembled vent pipe fit system. FIG. 9B, shows an enlarged cross-sectional view of the vent pipe fit system as illustrated in FIG. 9A.

Figure 10:
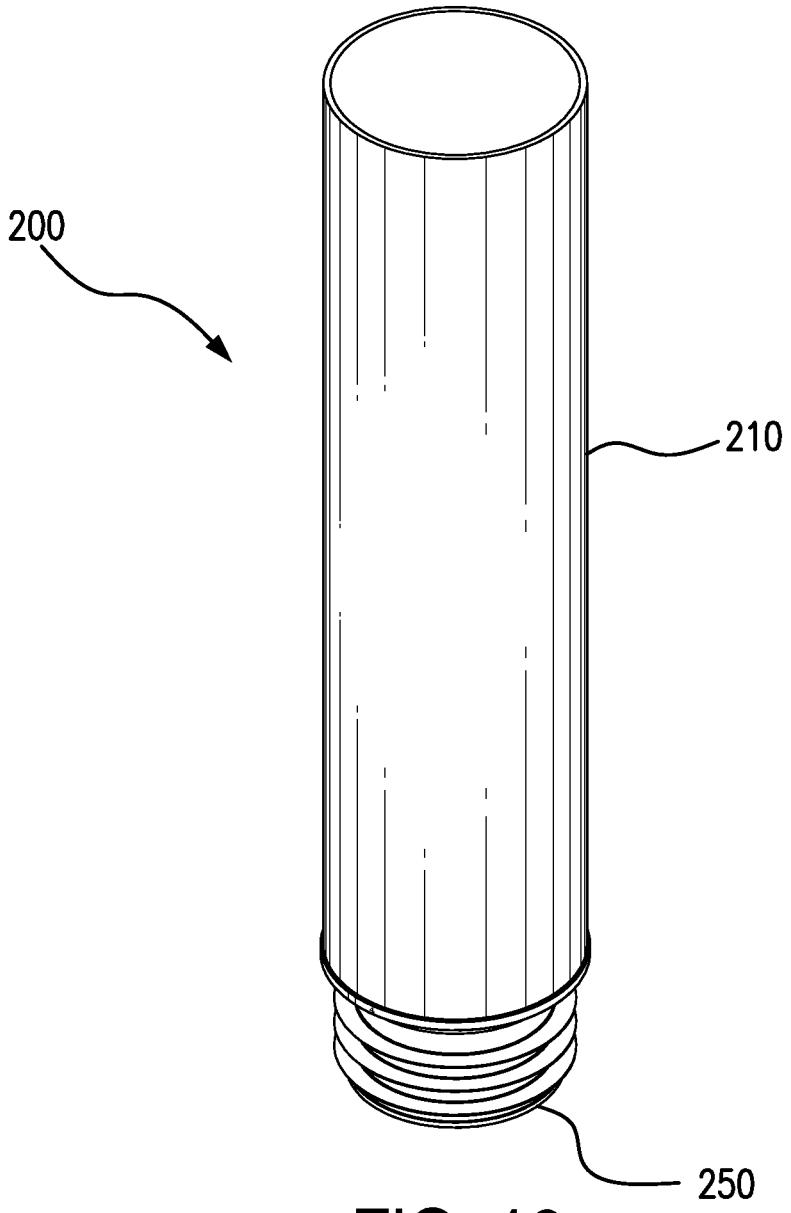
FIG. 10 is a perspective view of the vent pipe fit system embodiment completed and ready to use.

Turning now to FIG. 10, therein is shown a perspective view of the replacement pipe extension device 200. In this illustration, the rigid cylindrical extension portion (or replacement pipe section) 210 is shown equipped with a separable connection fitting 250. Depending on the requirements of the intended application, the replacement pipe section 210 and all or a portion of the connection fitting 250 may be provided as one unit, even integrally formed together as one unit.

Figure 11:
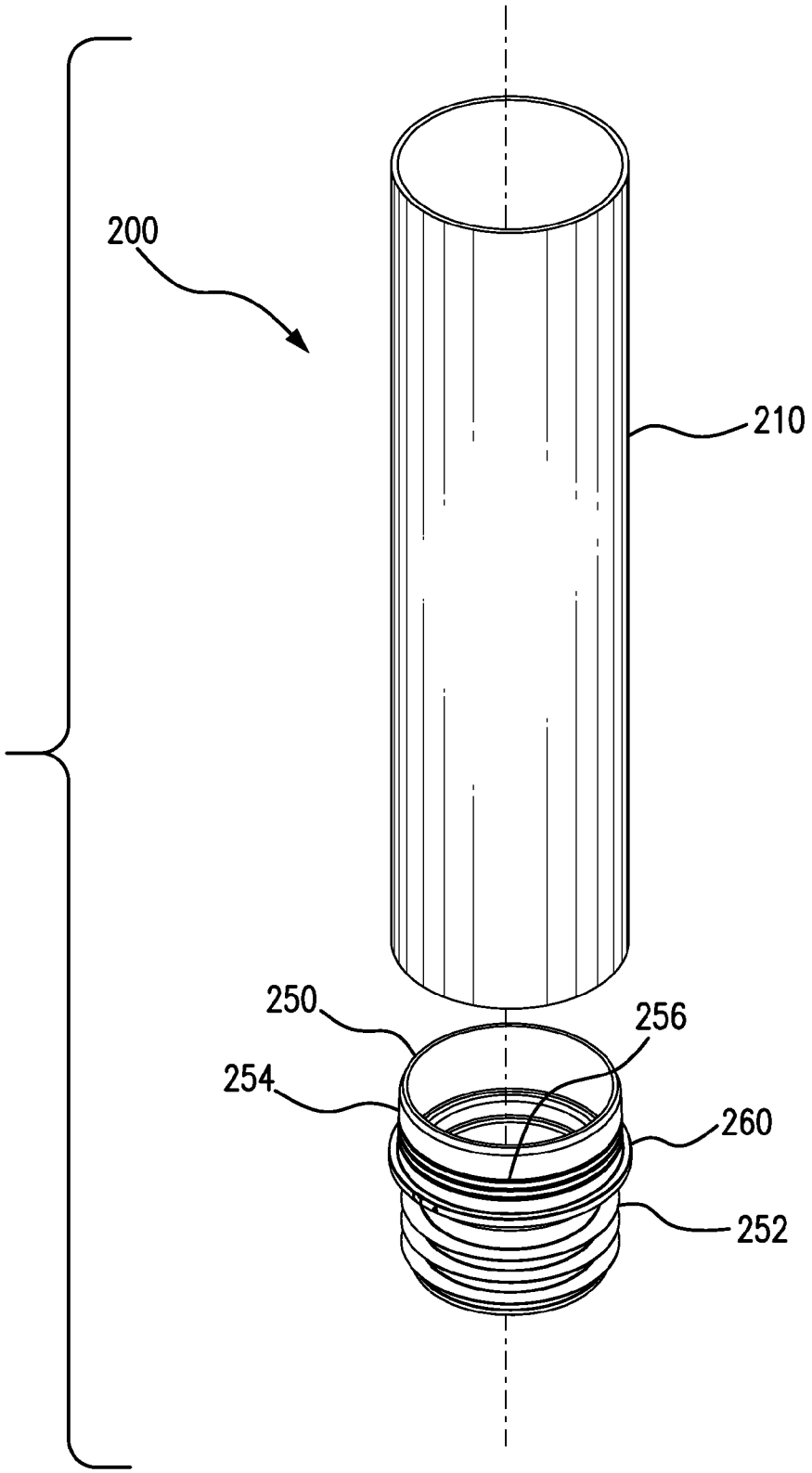
FIG. 11 is a perspective exploded view of the system as illustrated in FIG. 10.

Turning now to FIG. 11, there is shown an exploded perspective view of the illustration as shown in FIG. 10 showing the upper cylindrical surface 254 with adhesive capturing grooves 256 and flange feature 260. During assembly, an adhesive is applied to the upper cylindrical surface 254 of the connection fitting 250, then the connection fitting 250 with adhesive is inserted into the inside diameter of rigid cylindrical portion 210 until they two meet at the top surface of flange 260.

Figure 11A:
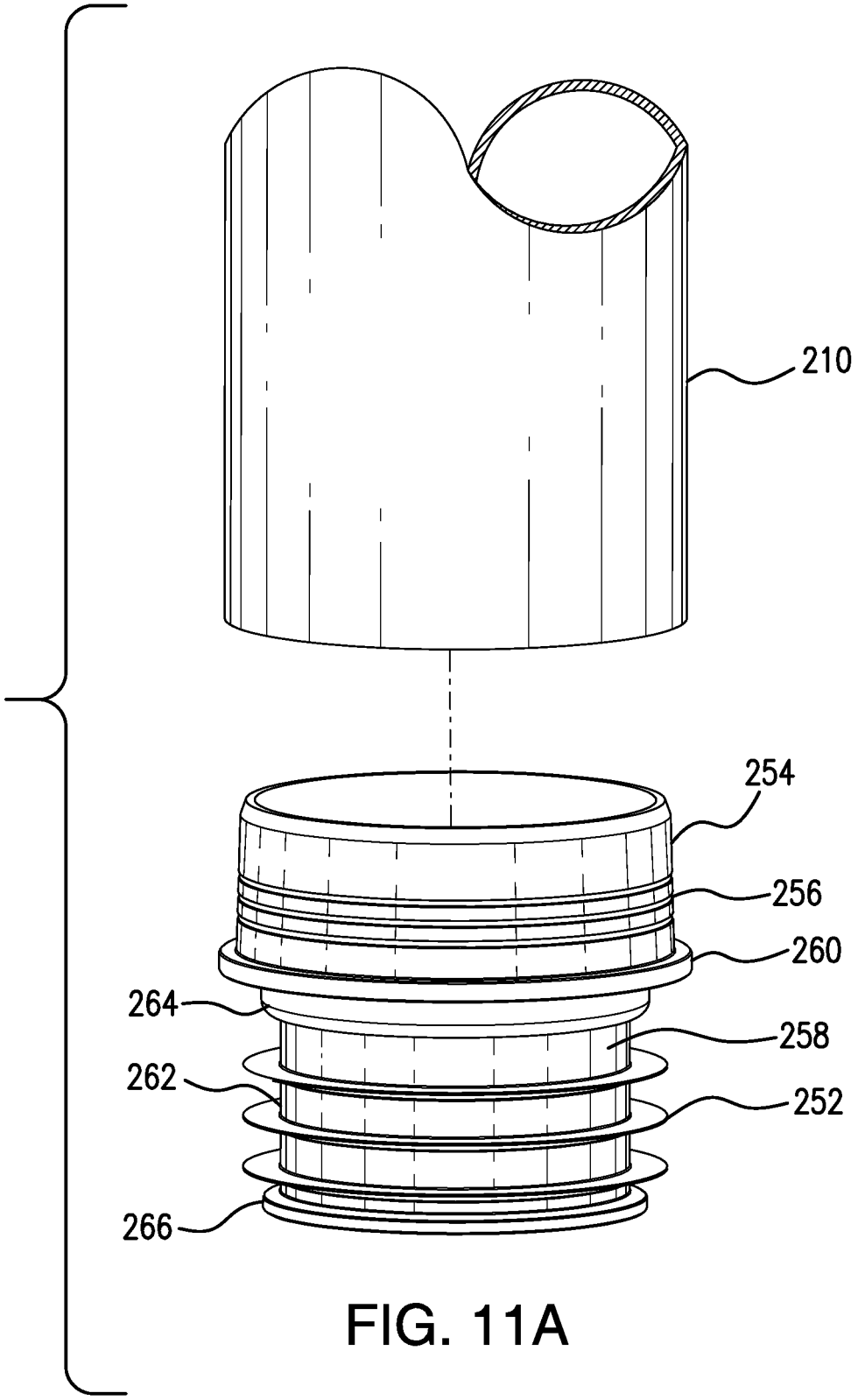
FIG. 11A is an enlarged perspective view of a portion of the vent pipe fit system embodiment of FIG. 10.

Turning now to FIG. 11A, there is shown an enlarged perspective exploded view of the replacement pipe section and the coupler unit.

Figure 12:
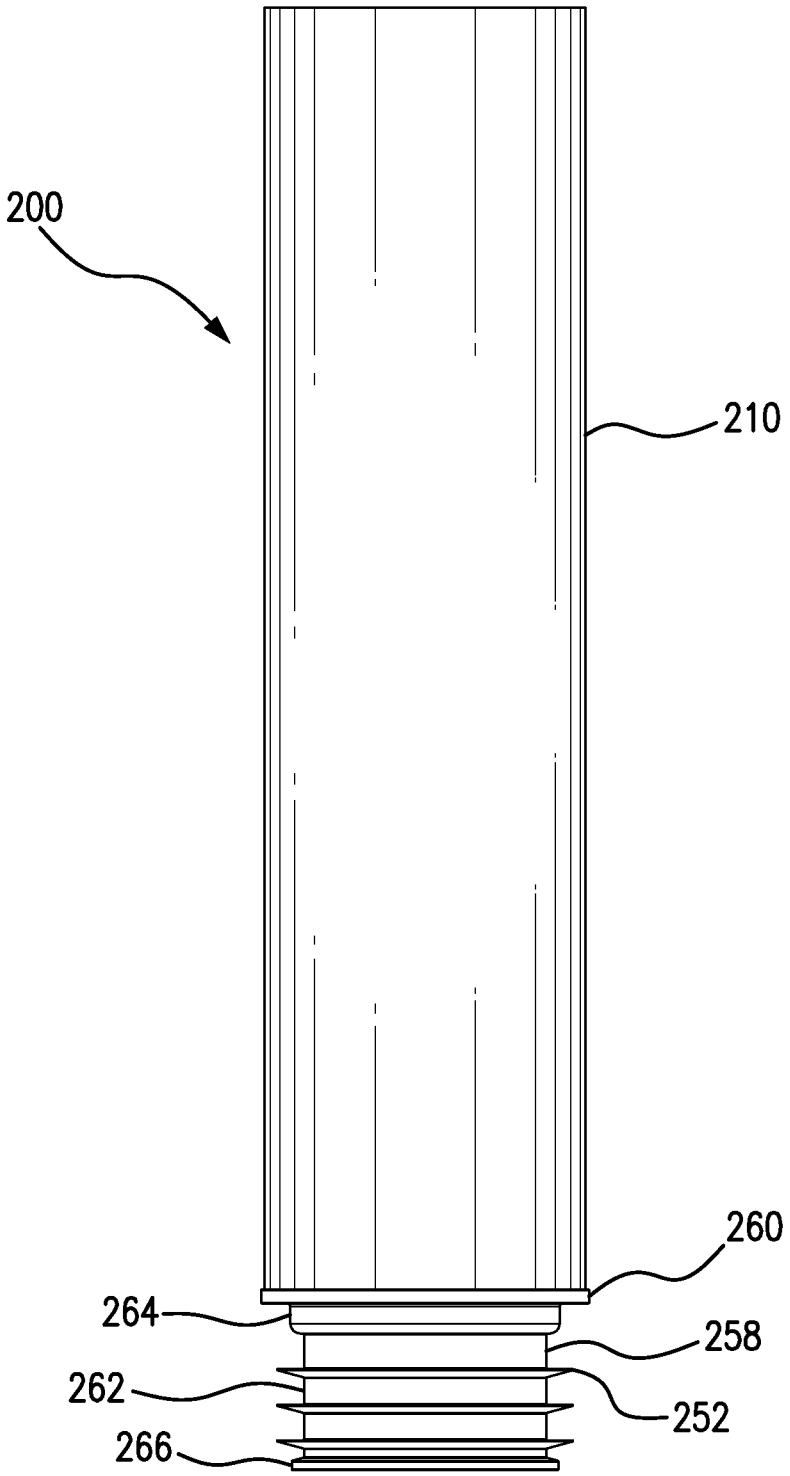
FIG. 12 is a front elevational view of the system embodiment as illustrated in FIG. 10.

Turning to FIG. 12, there is shown is a front elevational view of the replacement pipe extension device 200 assembled with rigid cylindrical extension portion 210 fully seated against flange 260. On the lower exposed cylindrical portion of the connection fitting 250 there are cylindrical support walls 264 and 266 which are a larger diameter than the radial fin support wall 262. Radial fin support wall 262 has a reduced diameter to allow the radial fin length sufficient for adequate bending during installation into the smallest existing pipe internal diameter that might be found in the field. Cylindrical support walls 264 and 266 are preferably sized at a minimum clearance for the smallest existing pipe internal diameter that might be found in the field and function to add support to the system when a side or torsional load is applied. In certain applications, the roof installation professional may deem it necessary for additional holding force or for additional sealing capacity. In these instances a sealant or adhesive may be applied to the connection fitting 250 at the surface 258, just above the topmost radial fin 252 and below the flange 260 prior to insertion into an existing pipe. This adhesive or sealant then becomes trapped and seals the connection fitting 250 to the inside surfaces of the existing pipe.

Figure 13:
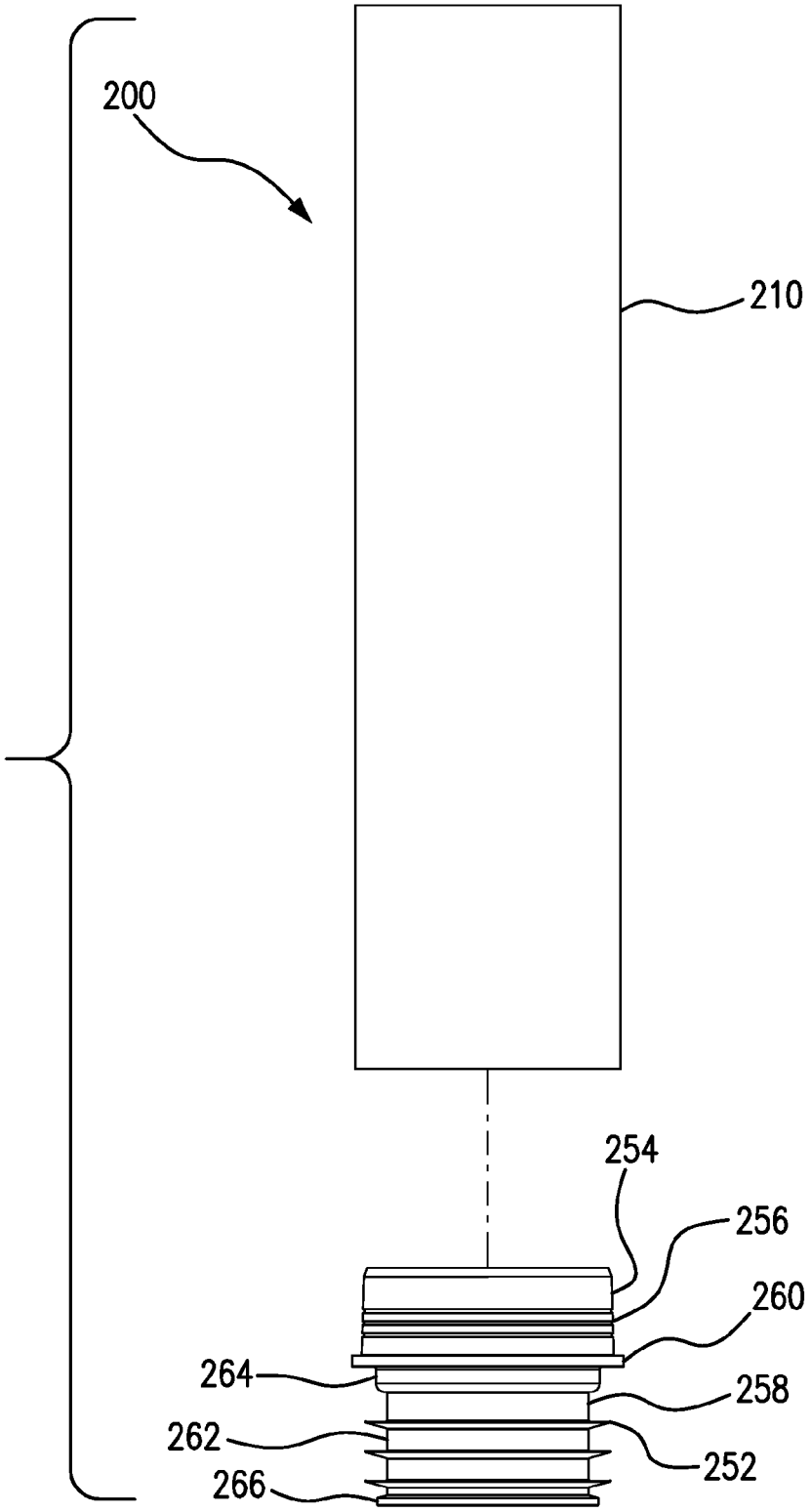
FIG. 13 is an exploded front elevational view of the system as illustrated in FIG. 12.

Turning to FIG. 13, there is shown an exploded front elevational view of the devices shown assembled in FIG. 12. The length of the rigid cylindrical extension 210 is suitably determined for a typical installation. For installations requiring a shorter vent pipe extension, the roof installation professional can simply cut the replacement pipe section 210 of the pipe extension device 200 to length.

Figure 14:
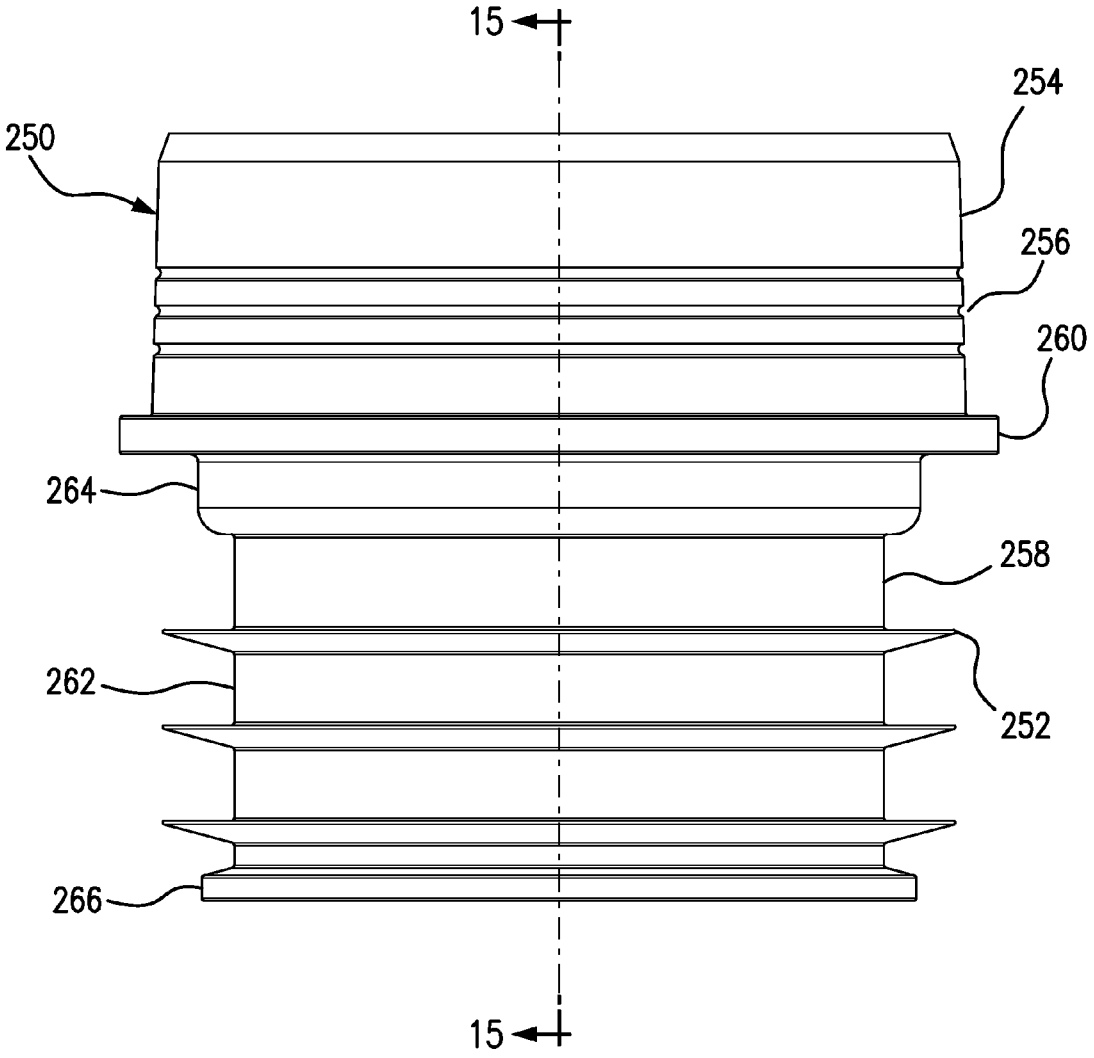
FIG. 14 is a front elevational view of the coupler unit as molded and before assembly into an exemplary embodiment of the vent pipe fit system.
Figure 14A:
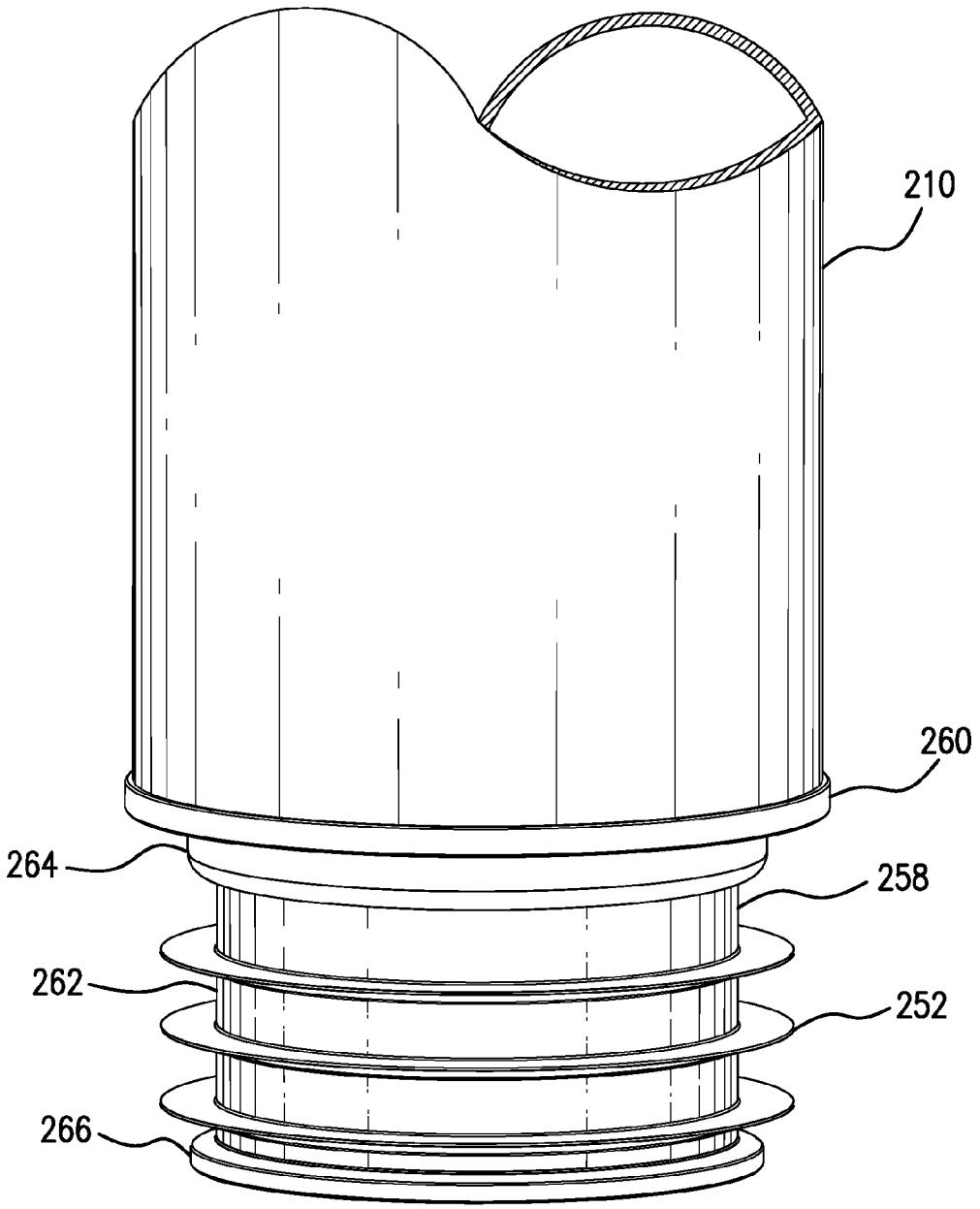
FIG. 14A is an enlarged perspective view of the coupler unit of the vent pipe fit system embodiment, shown with a replacement pipe section coupled thereto.

Turning now to FIG. 14, there is shown a front elevational view of the connection fitting/coupler unit 250 with the aforementioned features shown in more detail. FIG. 14A shows an enlarged perspective view of the coupler unit of the illustrated vent pipe fit system embodiment.

Turning to FIG. 15, there is shown a sectional view as taken from line 15-15 in FIG. 14 showing a detailed view of the connection fitting, or coupler unit 250. This more detailed view schematically illustrates the deflection of the wing-like radial fins 252 against an inner wall surface of the existing vent pipe section for adaptively sealed engagement therewith.

A need exists in the art to reliably, yet simply and economically, join one rigid pipe member to another, such that the resulting joint is firm and stable, and to do so without the need for obtrusive extraneous hardware. In various applications known in the art where rigid piping sections are joined together (for instance, to repair an existing underground or roof vent pipe), different measures are taken depending upon various factors such as the material composition of the pipe sections to be joined or repaired and the actual material that is conveyed through the piping sections. Typically where cast iron or other metallic piping is to be joined to a similar piping section, the two sections may simply be coaxially abutted to one another, with a rubber collar banded thereabout. Where structural radial support is not of concern (for instance when the piping sections are embedded in the earth), the sealing and constricting function of the surrounding rubber collar is sufficient to maintain the joint.

In various applications where a PVC vent pipe is joined to another PVC piping section, different-diameter piping may be used such that one section may be telescopically received in the other. Alternatively, the two sections may be ensleeved by a surrounding tubular section and adhesively secured to finish the joint.

Such jointing measures are typically not practicable for certain applications, such as in-situ roof vent piping repair applications. For example, where a vent pipe that is already installed in an existing building structure (and passed through the building's roof), repairing or replacing a portion of that vent pipe severely restricts the techniques that may be employed. Typically, space limitations and existing obstructions preclude the use/installation of collar-like hardware. Additionally, simply installing an elastomeric rubber collar about two separate sections will not provide sufficient support to retain the joint.

As described in preceding paragraphs, the connection fitting/coupler unit 250 shown in FIG. 15 and elsewhere herein provides a simple yet effective tool for secure coaxial attachment of a replacement pipe portion 210 to an existing vent pipe section 100 (see for example FIG. 9). The connection fitting 250 includes a first (lower) section and a second (upper) section as can be seen clearly in FIGS. 11, 11A, 13, 14, 15 and 16. The second (upper) section is configured and dimensioned to fit tightly (and coaxially) within the bottom end of a replacement pipe section 210. The first (lower) section of the connection fitting 250 extends axially downward from the second section to easily insert into an existing vent pipe section 100. This first section is preferably formed with a plurality of radially extending flanges 252 which, depending on the particularly intended application, may be formed with different degrees of flexibility. The radial flanges 252 deflect (as illustrated by the broken lines in FIG. 15), to permit convenient coaxial insertion into the upper end of the existing vent pipe section 100. Once fully inserted, however, the radial flanges 252 serve additionally as reinforcing barbs which act against the surrounding inner surfaces of the existing vent pipe section 100 to resist removal from that existing pipe 100. The connecting fitting's axial insertion into both the replacement pipe section of the pipe extension device 200 and the lower existing pipe 100 provides a splint-like lateral reinforcement of the joint. The frictional engagement of its first and second sections within the surrounding inner surfaces of the replacement pipe portion of the pipe extension device 200 and existing pipe 100 also guards/reinforces against the joint's disassembly.

Figure 16:
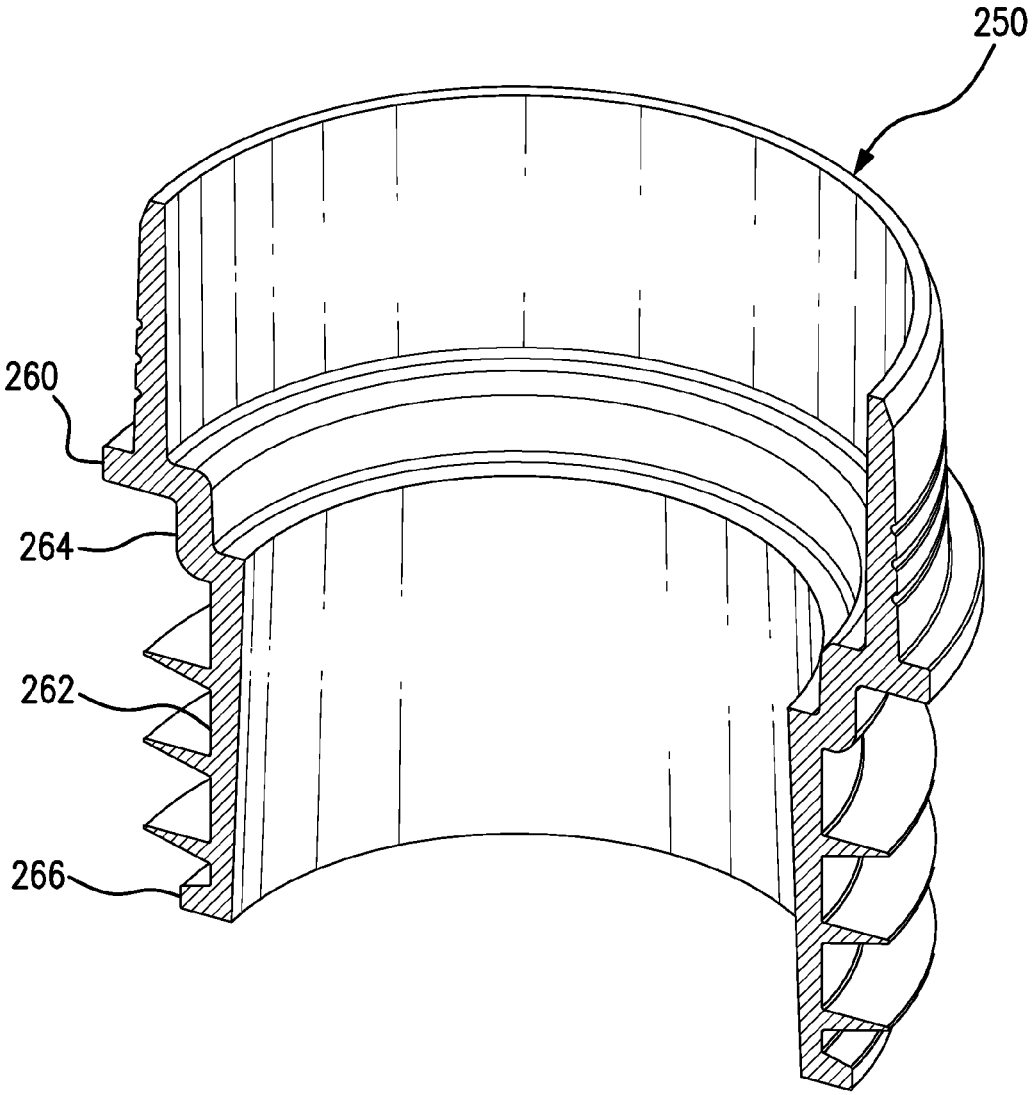
FIG. 16 is a rotated sectional cut-away view of the connection fitting as illustrated in FIG. 15.

Turning to FIG. 16, there is shown the sectional view as illustrated in FIG. 15 rotated to a perspective view for better clarity of the detailed features on the connection fitting 250.

Figure 17:
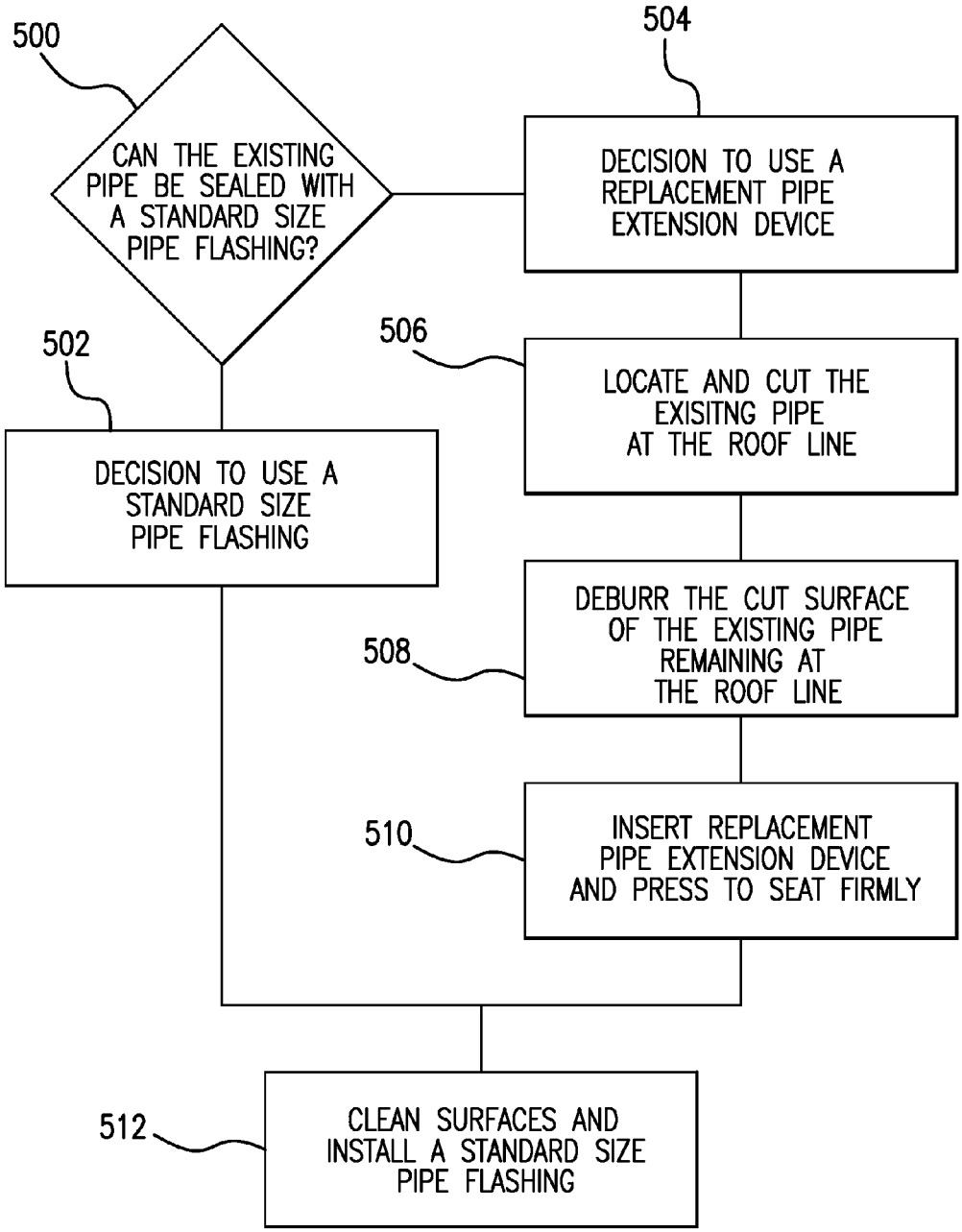
FIG. 17 is a flow diagram showing the processes carried out in a method realized in accordance with an exemplary embodiment of the present invention for replacement of a vent pipe traversing an external surface of a roof structure.

Turning now to FIG. 17, there is shown a flow diagram illustrating the decision and process steps used to implement the method formed in accordance with an embodiment of the present invention. First, upon evaluation of the existing pipe penetrating the roof, the roof installer will determine 500 if the existing pipe is capable of being sealed with a standard flashing component. If the decision is that the existing pipe penetrating the roof can be sealed correctly 502, then the roof installer will prepare and install the standard pipe flashing 512. If the decision is that the existing pipe penetrating the roof cannot be sealed correctly 504, then the roof installer prepares to remove the unsealable portion of the existing pipe. The roof installer then locates the correct cut position and cuts and removes 506 the unsealable portion of the existing pipe penetrating the roof. Once the cut is complete and the unsealable portion of the pipe has been removed, the roof installer will de-burr 508 the inner cut diameter of the existing pipe which remains. The roof installer is now ready to insert a replacement pipe extension device into the cut end of the existing pipe. The replacement pipe extension device is inserted 510 and pressed until fully seated against the cut surface of the existing pipe. The installer now prepares and installs the standard size pipe flashing component over the replacement pipe extension device. The pipe flashing task is now completed and the roof installer can continue with the installation of the roof covering materials up the roof.

Turning now to FIGS. 18A-18H there are shown various stages of reliable partial replacement of a vent pipe traversing an external surface of a structure accomplished in accordance with certain embodiments of the subject invention.

Figure 18A:
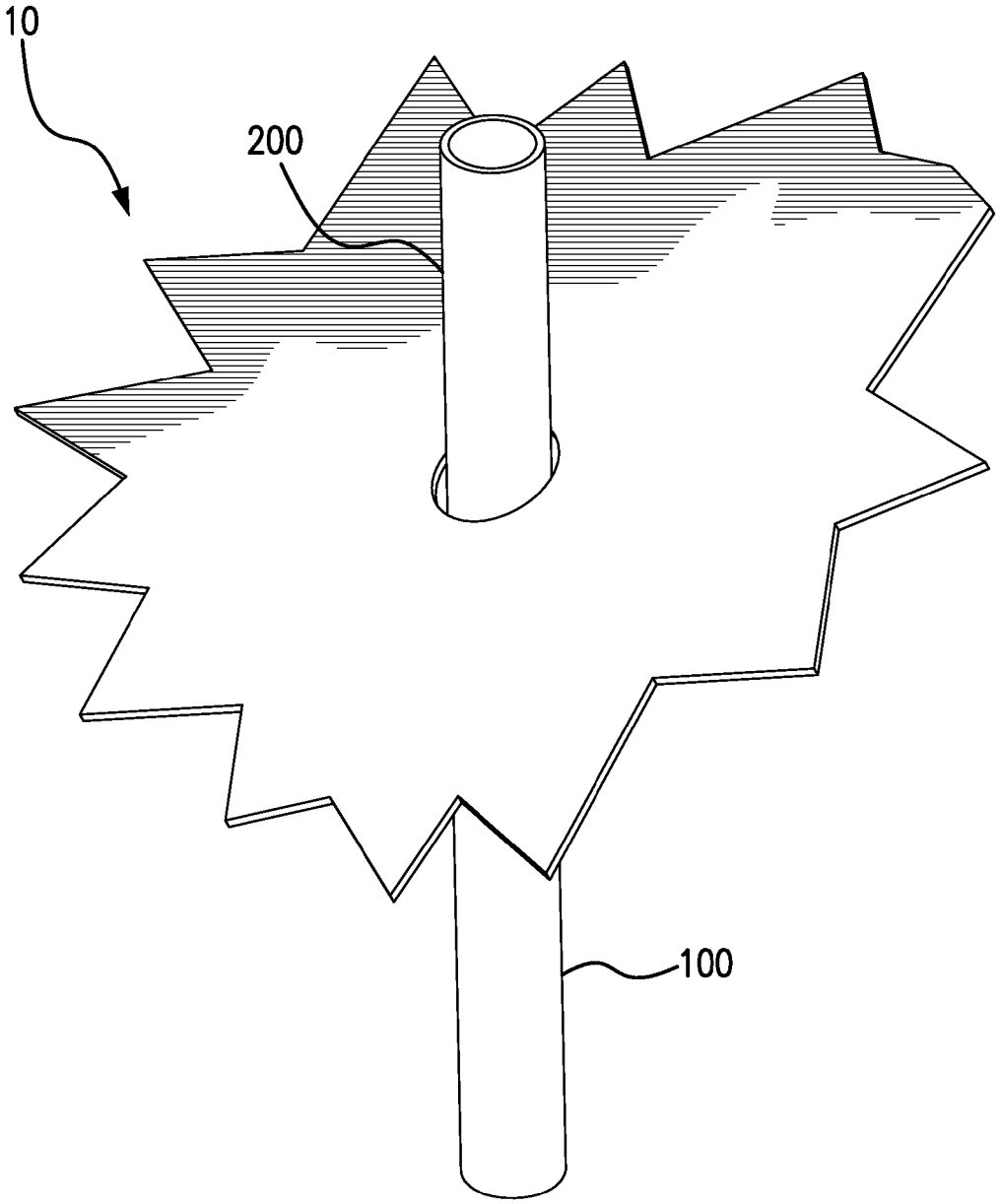
FIG. 18A is a perspective view illustrating a portion of a roof structure wherein an existing vent pipe penetrates the roof sheathing, the roof covering material removed.

FIG. 18A is a perspective view illustrating a portion of a roof structure wherein an existing vent pipe penetrates the roof sheathing, the roof covering material removed. Once it is determined that the existing vent pipe needs replacement, it is cut and removed. The result is illustrated in FIG. 18B which is a perspective view of the portion of a roof structure shown in FIG. 18A, shown after a portion of the existing vent pipe is cut and removed.

Figure 18B:
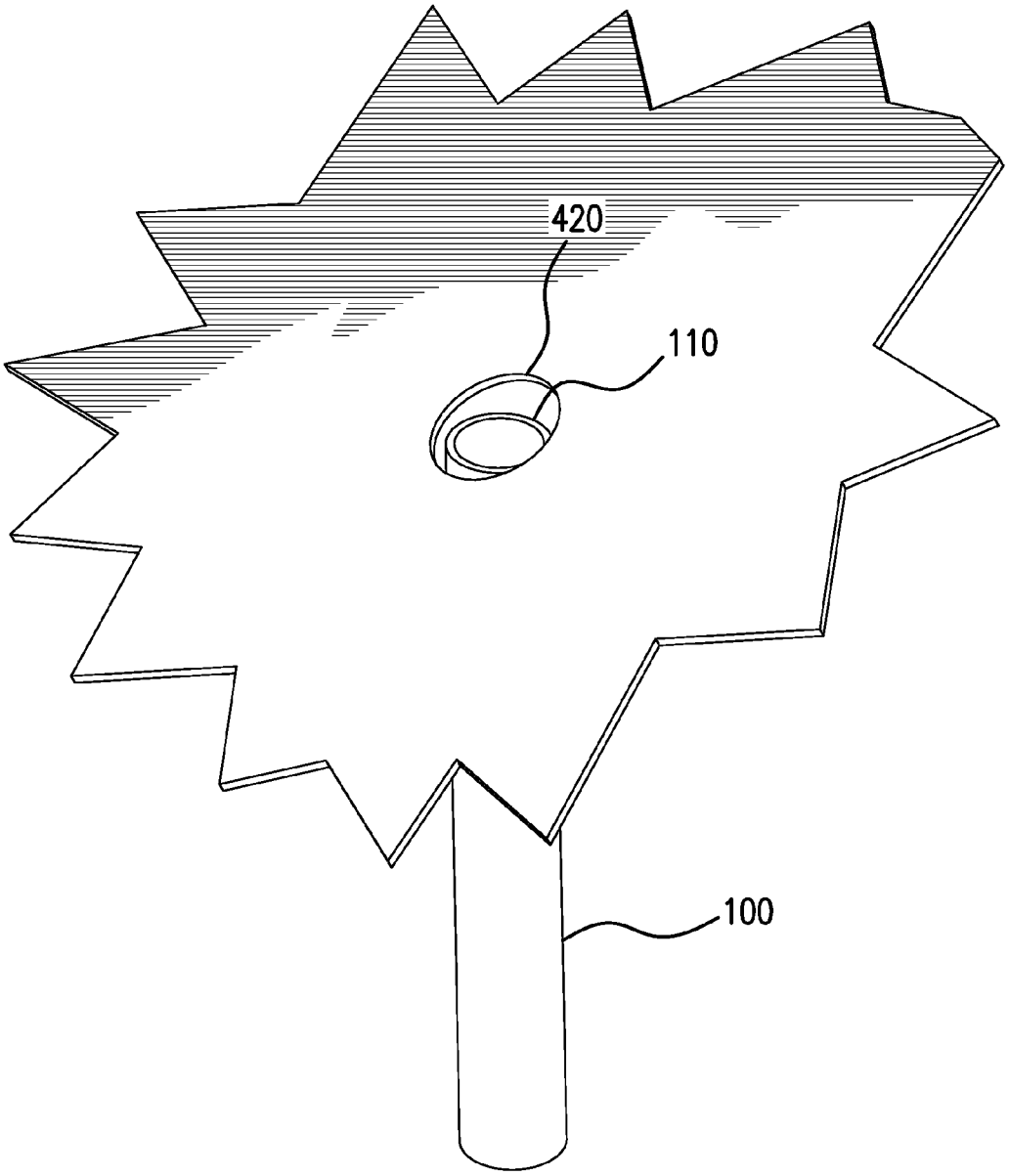
FIG. 18B is a perspective view of the portion of a roof structure shown in FIG. 18A, shown after a portion of the existing vent pipe is cut and removed.
Figure 18C:
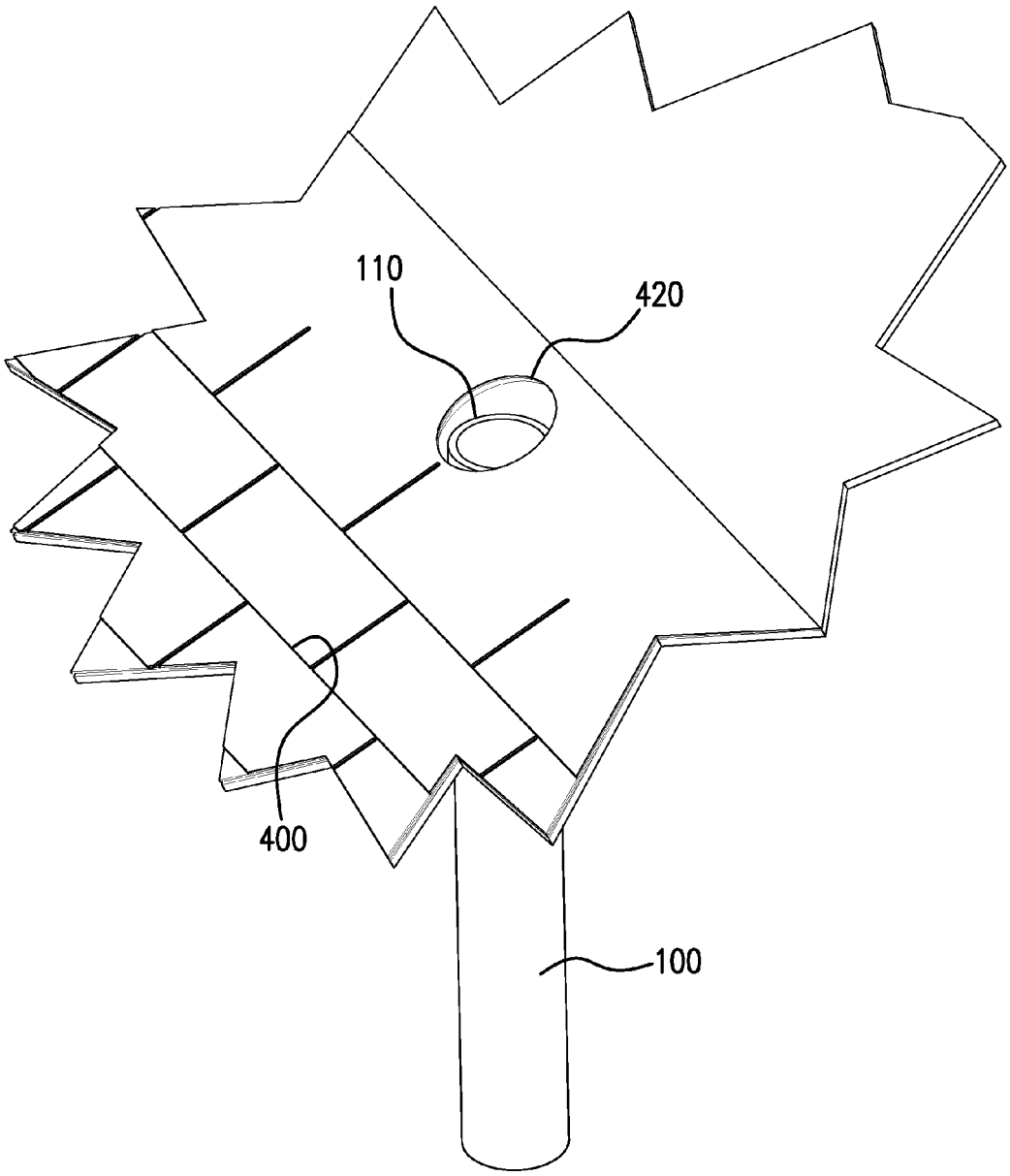
FIG. 18C is a perspective view of the portion of a roof structure shown in FIG. 18B, shown with roof covering material installed up to the existing vent pipe location.

After a portion of the existing vent pipe has been cut and removed (as shown in FIG. 18B), it may be desirable in some instances to install roof covering material up to the point of the existing vent pipe location as illustrated in FIG. 18C.

Figure 18D:
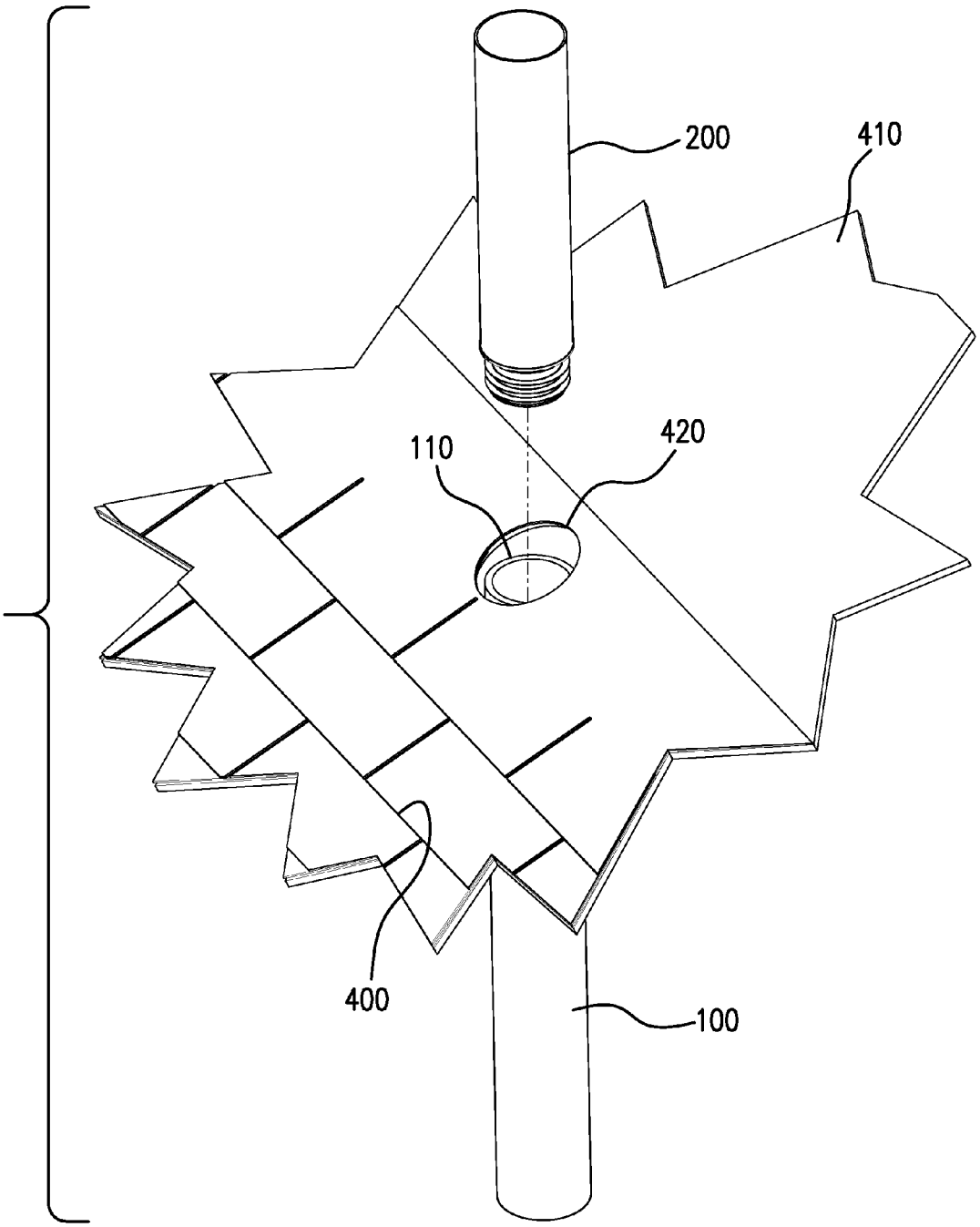
FIG. 18D is an exploded perspective view of the portion of a roof structure shown in FIG. 18C, illustrating a portion of a vent pipe fit system embodiment such as illustrated in FIG. 5 for engagement with a remaining portion of the existing vent pipe.

Next, the coupler unit is coaxially engaged with the replacement pipe section. FIG. 18D is an exploded perspective view of the portion of a roof structure shown in FIG. 18C, illustrating a portion of a vent pipe fit system embodiment such as illustrated in FIG. 5 for engagement with a remaining portion of the existing vent pipe.

Figure 18E:
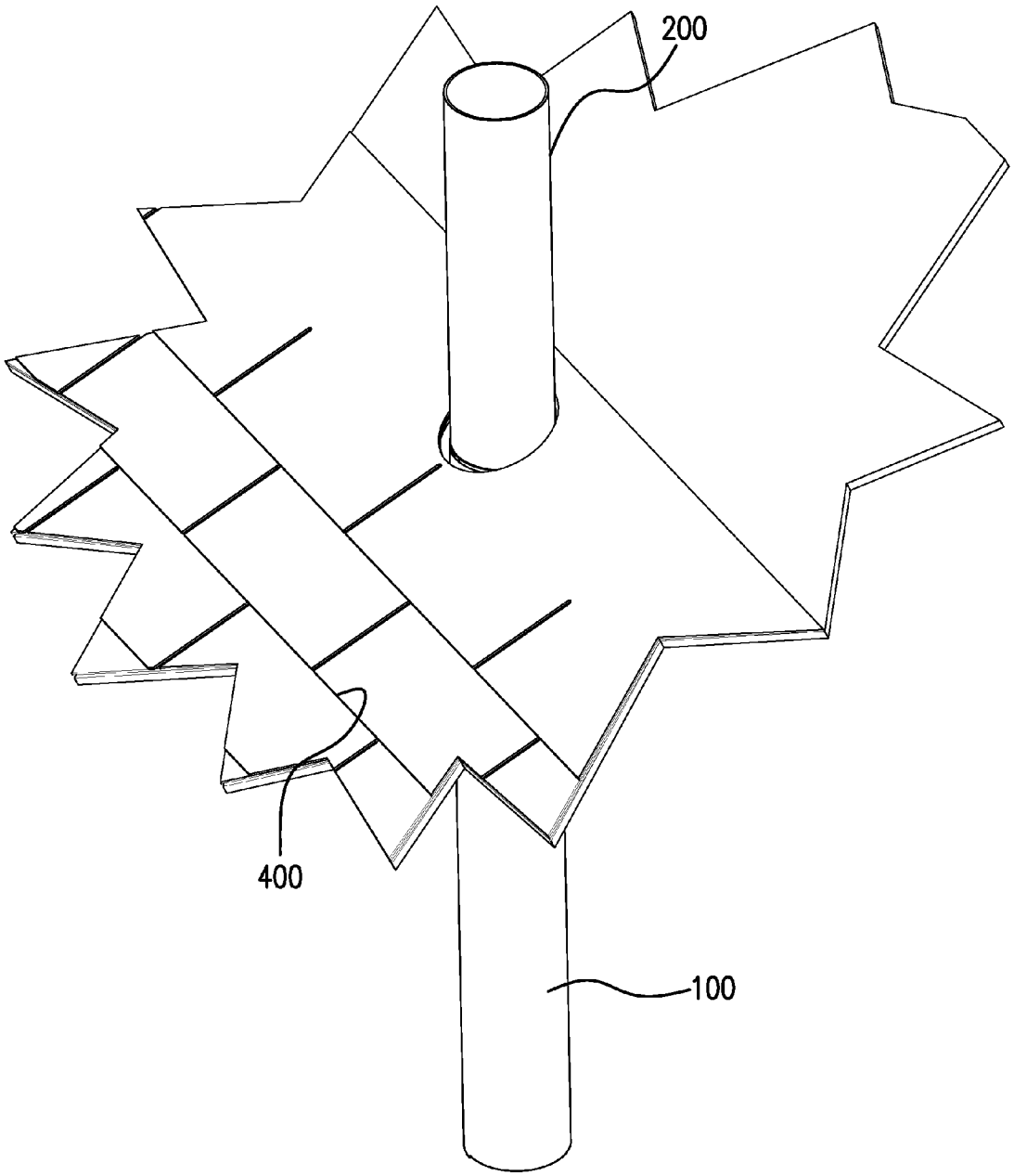
FIG. 18E is an assembled perspective view of the portion of a roof structure shown exploded in FIG. 18D, with the portion of the vent pipe fit system embodiment shown assembled to the remaining portion of the existing vent pipe.

Thereafter, the coupler unit and replacement pipe section are installed by inserting the coupler unit first section into the existing vent pipe section. FIG. 18E is an assembled perspective view of the portion of a roof structure shown exploded in FIG. 18D, with the portion of the vent pipe fit system embodiment shown assembled to the remaining portion of the existing vent pipe.

Figure 18F:
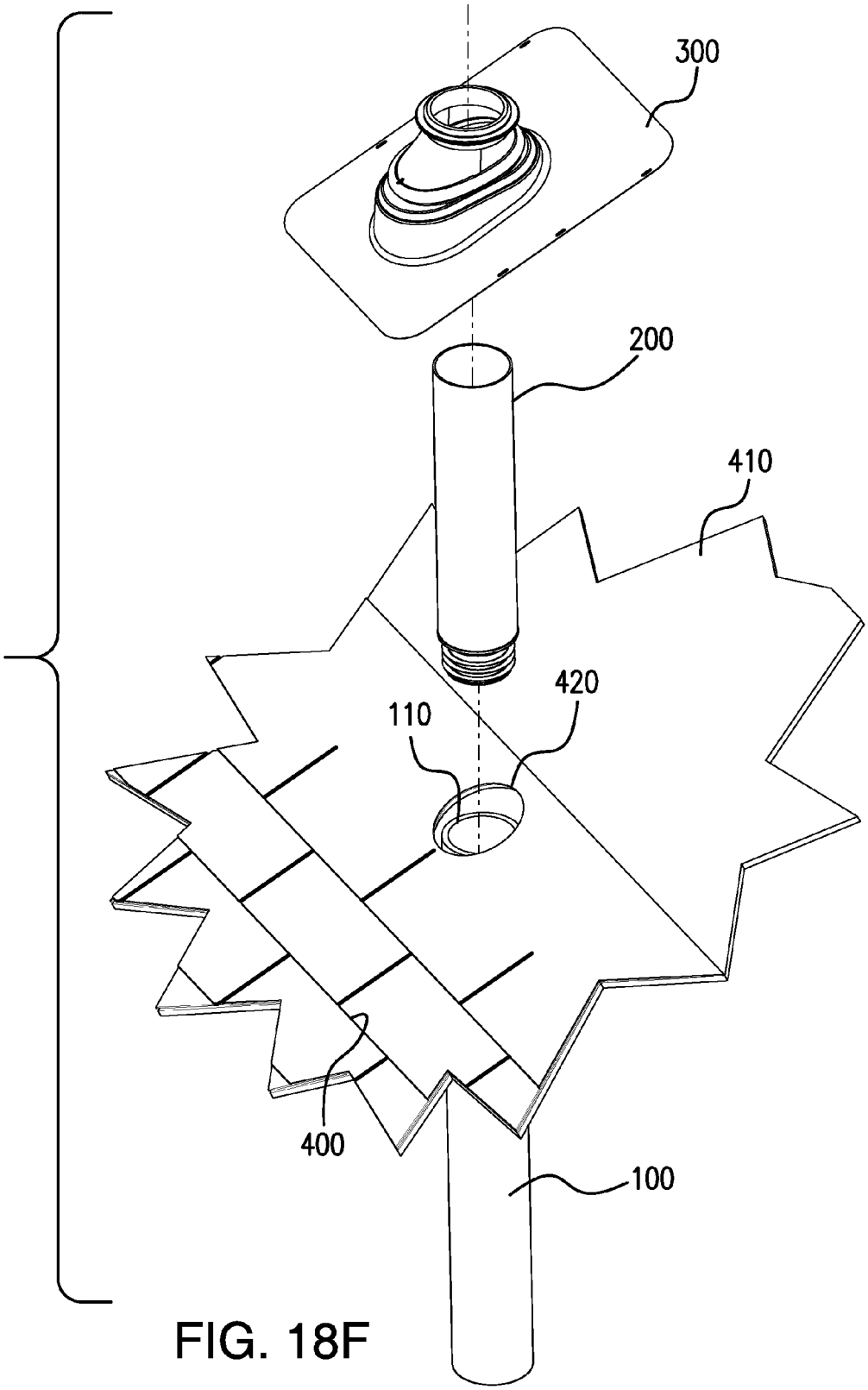
FIG. 18F is an exploded perspective view of the portion of a roof structure shown in FIG. 18D, illustrating a further portion of a vent pipe fit system embodiment such as illustrated in FIG. 5 for protectively covering a point of engagement to the remaining portion of the existing vent pipe.
Figure 18G:
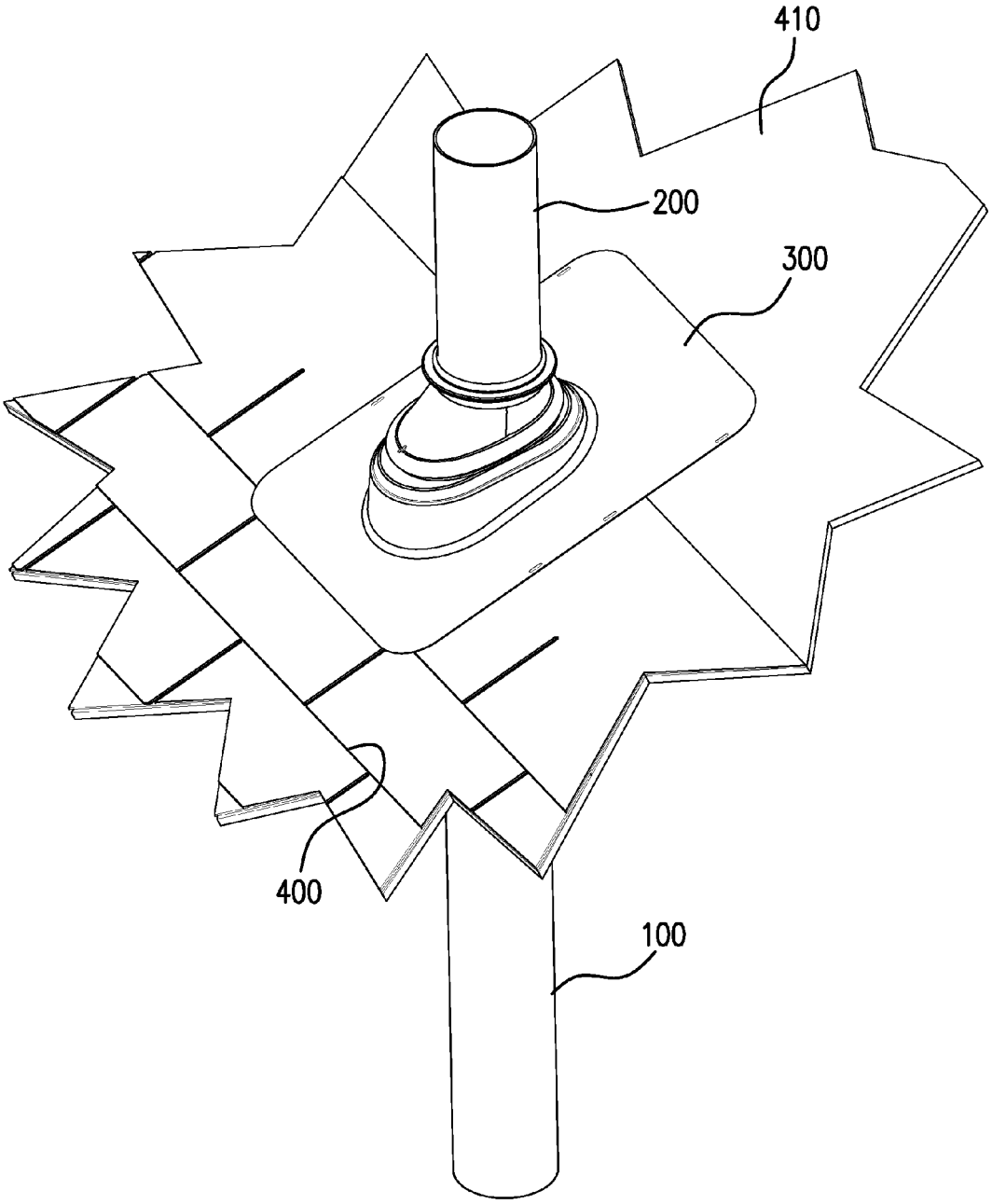
FIG. 18G is an assembled perspective view of the portion of a roof structure shown exploded in FIG. 18F, with the illustrated portions of the vent pipe fit system embodiment assembled to the remaining portion of the existing vent pipe; and, FIG. 18H is a perspective view of the portion of a roof structure as shown in FIG. 18G, with roof covering material fully installed about the existing vent pipe location.

Then, a flashing unit is added in a sealed manner to the replacement pipe section above the coupler unit. FIG. 18F is an exploded perspective view of the portion of a roof structure shown in FIG. 18D, illustrating a flashing unit for protectively covering a point of engagement to the remaining portion of the existing vent pipe. FIG. 18G provides an assembled perspective view of the portion of a roof structure shown exploded in FIG. 18F, with the illustrated portions of the vent pipe fit system embodiment assembled to the remaining portion of the existing vent pipe.

Figure 18H:
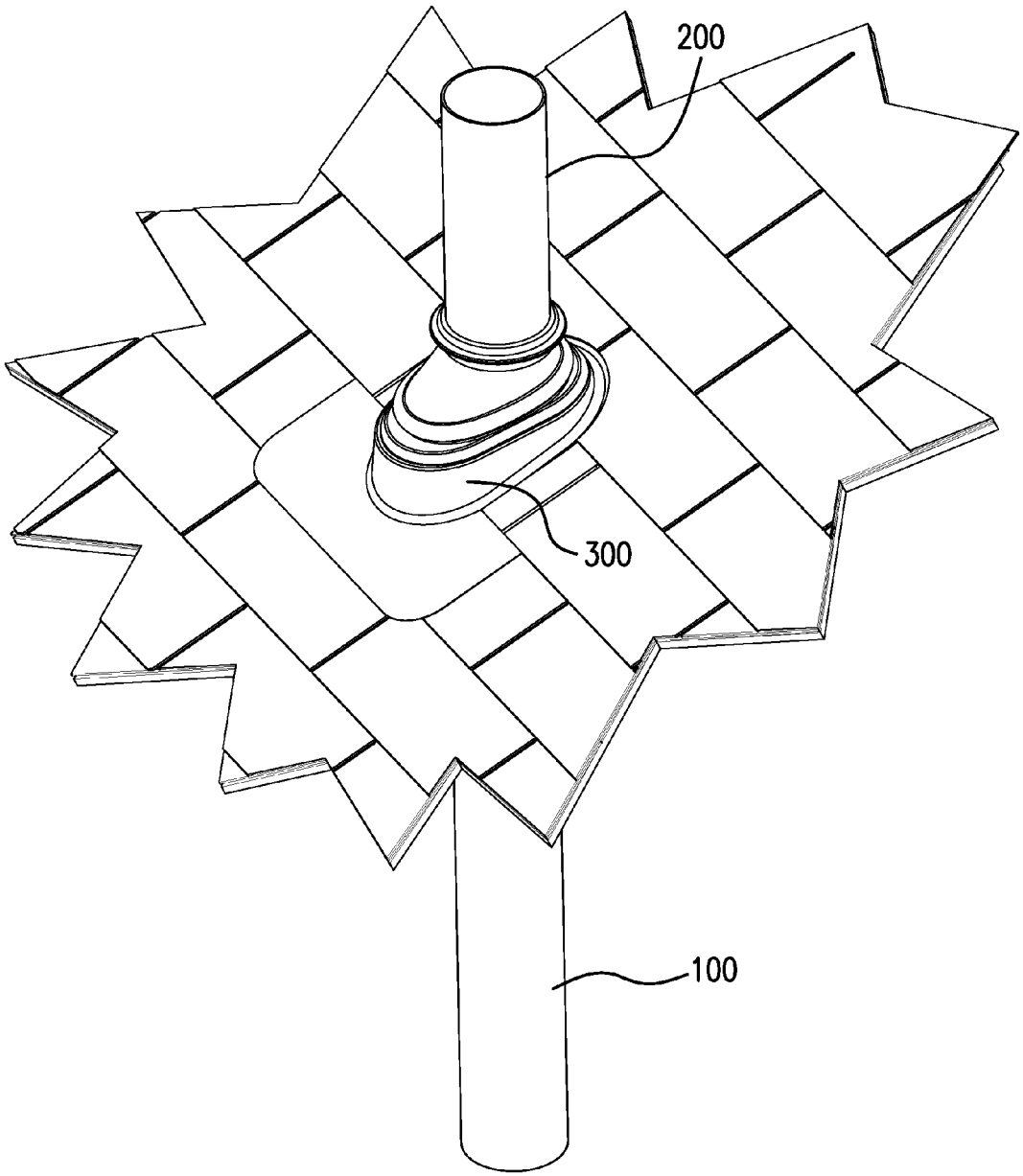

Subsequent to coupling the pipe flashing unit to the replacement pipe section, replacement roof covering material may be installed about the existing vent pipe location as shown in FIG. 18H.

Although the detailed embodiment described above is centered on vent pipe applications penetrating a roof structure, there are many instances where a non-pressure pipe structure may need to be extended. The present invention is suitable for many if not all of these applications, including free air intake for combustion devices like gas or propane furnaces or hot water heaters, free air intakes for gas fireplaces, combustion exhaust venting for similar appliances, rigid exhaust vents for bathroom fans, passive vents for closed spaces, foundation vents and radon remedial exhaust vents, etc. Hence, the device has many applications outside of the system and method described above.

The descriptions above are intended to illustrate possible implementations of the present invention and are not restrictive. While this disclosure has been made in connection with specific forms and embodiments thereof, it will be appreciated that various modifications other than those discussed above may be resorted to without departing from the spirit or scope of the claimed invention. Such variations, modifications, and alternatives will become apparent to the skilled artisan upon review of the disclosure. For example, functionally equivalent elements or method steps may be substituted for those specifically shown and described, and certain features may be used independently of other features, and in certain cases, particular locations of elements or sequence of method steps may be reversed or interposed, all without departing from the spirit or scope of the invention as defined in the appended Claims. The scope of the claimed invention should therefore be determined with reference to the description above and the appended claims, along with their full range of equivalents.

What is claimed is:

1. A pipe fit system for reliable partial replacement of an existing pipe traversing an external surface of a structure comprising:

a replacement pipe section;

a coupler unit extending from said replacement pipe section for installation onto an existing pipe section, said coupler unit defining an inner passage for communication between the replacement and existing pipe sections therethrough, said coupler unit including:

a first section extending from an intermediate section for coaxially engaging the existing pipe section, said first section including a trunk portion and an adaptive engagement portion extending radially outward therefrom to deflectably engage an inner surface of the existing pipe section at a portion offset from said intermediate section and thereby define a sealed space about at an outer wall surface section of said trunk portion; and, a second section joined to said first section by said intermediate section, said second section coaxially engaging said replacement pipe section in conformed manner, said intermediate section including a shoulder portion defining an outermost diameter thereof and extending radially beyond at least one of said first and second sections and substantially aligning diametrically with at least one of said replacement and existing pipe sections.

2. The pipe fit system as recited in claim 1, wherein said first and second sections are coaxially aligned.

3. The pipe fit system as recited in claim 1, wherein said adaptive engagement portion includes at least one radial fin extending annularly about said trunk portion to project radially outward therefrom, said radial fin being deflectable.

4. The pipe fit system as recited in claim 3, wherein said radial fin is integrally formed with said trunk portion.

5. The pipe fit system as recited in claim 3, further comprising a plurality of radial fins spaced axially from one another.

6. The pipe fit system as recited in claim 3, wherein said first, second, and intermediate sections of said coupler unit are integrally formed with one another, said shoulder portion of said intermediate section extending radially beyond both said trunk portion of the first section and said second section.

7. The pipe fit system as recited in claim 3, wherein said trunk portion terminates axially at a bottom flange, said radial fin extending radially beyond said bottom flange.

8. The pipe fit system as recited in claim 1, wherein at least a portion of said coupler unit is detachably coupled to said replacement pipe section.

9. The pipe fit system as recited in claim 1, wherein said adaptive engagement portion of said coupler unit first section is integrally formed of a resilient material.

10. The pipe fit system as recited in claim 9, wherein said adaptive engagement portion of said coupler unit first section projects radially outward from said trunk portion.

11. The pipe fit system as recited in claim 1, further comprising a pipe flashing unit coupled in sealed manner to said replacement pipe section, said pipe flashing unit including a sealing portion extending about said replacement pipe section to enshroud said coupler unit and a joint formed thereby with the existing pipe section.

12. A vent pipe fit system for retrofitting a section of a vent pipe traversing an external surface of a structure comprising:

a replacement pipe section;

a coupler unit detachably coupled to said replacement pipe section for installation on an existing vent pipe section, said coupler unit defining an inner passage for communication between the replacement and existing vent pipe sections therethrough, said coupler unit including:

a first section extending from an intermediate section for coaxially engaging the existing vent pipe section, said first section including a trunk portion and an adaptive engagement portion extending radially outward therefrom, said adaptive engagement portion including a plurality of deflectable radial fins axially spaced one from the other, each said radial fin being disposed annularly about said trunk portion to extend radially outward therefrom at a portion offset from said intermediate section and thereby define at least one sealed space about at an outer wall surface section of said trunk portion; and, a second section coaxially joined to said first section by said intermediate section, said second section coaxially engaging said replacement pipe section in conformed manner, said intermediate section including a shoulder portion defining an outermost diameter thereof and extending radially beyond said second section and each of said radial fins to substantially align diametrically with at least one of said replacement and existing vent pipe sections;

wherein said radial fins deflectably engage an inner surface of the existing vent pipe section upon engagement of said coupler unit therewith.

13. The vent pipe fit system as recited in claim 12, wherein said radial fins are integrally formed with said trunk portion of a resilient material; and, first and second sections each define a cylindrical inner surface.

14. The vent pipe fit system as recited in claim 13, further comprising a pipe flashing unit coupled in sealed manner to said replacement pipe section, said pipe flashing unit including a sealing portion extending about said replacement pipe section to enshroud said coupler unit and a joint formed thereby with the existing vent pipe section.

15. A method for reliable partial replacement of a vent pipe traversing an external surface of a structure comprising:

cutting away a terminal section of the vent pipe extending from the structure beyond the external surface to leave an existing vent pipe section;

establishing a replacement pipe section;

configuring a coupler unit to include:

a first section extending from an intermediate section and contoured to coaxially engage the existing vent pipe section, said first section including a trunk portion and an adaptive engagement portion extending radially outward therefrom to deflectably engage an inner surface of the existing vent pipe section at a portion offset from said intermediate section and thereby define a sealed space about at an outer wall surface section of said trunk portion; and, a second section joined to said first section by said intermediate section, said second section contoured to coaxially engage said replacement pipe section in conformed manner, said intermediate section including a shoulder portion defining an outermost diameter thereof and extending radially beyond at least one of said first and second sections and substantially aligning diametrically with at least one of said replacement and existing vent pipe sections;

detachably coupling said coupler unit by said second section thereof to said replacement pipe section;

installing said coupler unit and said replacement pipe section by coaxially inserting said coupler unit first section into the existing vent pipe section, said coupler unit defining an inner passage for communication between the replacement and existing vent pipe sections therethrough; and, coupling a pipe flashing unit in sealed manner to said replacement pipe section above said coupler unit, said pipe flashing unit including a sealing portion situated to extend about said replacement pipe section for enshrouding said coupler unit and a joint formed thereby with the existing vent pipe section.

16. The method as recited in claim 15, wherein the structure is a building, and the external surface traversed by the vent pipe is a roof surface, the method further comprising removal of at least portion of a roof covering material from the roof surface about the vent pipe prior to coupling said pipe flashing unit to said replacement pipe section.

17. The method as recited in claim 16 further comprising addition of a replacement roof covering material to the roof surface subsequent to coupling said pipe flashing unit to said replacement pipe section.

18. The method as recited in claim 15, wherein said adaptive engagement portion includes at least one radial fin extending annularly about said trunk portion, said radial fin being deflectable, the method further comprising deflection of said radial fin against an inner surface of said existing vent pipe section upon coaxially insertion of said coupler unit first section into the existing vent pipe section.

19. The method as recited in claim 15, wherein said shoulder portion of said intermediate section extends radially beyond both said trunk portion of the first section and said second section, the method further comprising capturing said shoulder portion between a terminal edge of both said replacement pipe section and the existing vent pipe section.

20. The method as recited in claim 15, wherein a holding point is defined by coaxially coupling said coupler unit to the existing pipe section for maintaining said replacement pipe section installed thereon, a supplemental holding point being formed by annularly affixing said sealing portion of said pipe flashing unit about said replacement pipe section.

* * * * *